US012410952B2

(12) United States Patent
Ueda et al.

(10) Patent No.: US 12,410,952 B2
(45) Date of Patent: Sep. 9, 2025

(54) COMPRESSOR DEVICE AND REFRIGERATION APPARATUS

(71) Applicant: DAIKIN INDUSTRIES, LTD., Osaka (JP)

(72) Inventors: Hitoshi Ueda, Osaka (JP); Mikio Kajiwara, Osaka (JP); Youhei Nishide, Osaka (JP); Naoto Tomioka, Osaka (JP); Yousuke Ohnishi, Osaka (JP); Daisuke Okamoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 22 days.

(21) Appl. No.: 18/367,936

(22) Filed: Sep. 13, 2023

(65) Prior Publication Data

US 2023/0417461 A1 Dec. 28, 2023

Related U.S. Application Data

(63) Continuation of application No. PCT/JP2022/009068, filed on Mar. 3, 2022.

(30) Foreign Application Priority Data

Mar. 16, 2021 (JP) ..... 2021-042770

(51) Int. Cl.
*F25B 31/02* (2006.01)
*F04C 18/02* (2006.01)
(Continued)

(52) U.S. Cl.
CPC ..... *F25B 31/026* (2013.01); *F04C 18/0215* (2013.01); *F04C 23/005* (2013.01);
(Continued)

(58) Field of Classification Search
CPC .... F04C 18/0215; F04C 23/005; F04C 23/02; F04C 29/026; F04C 2240/40;
(Continued)

(56) References Cited

U.S. PATENT DOCUMENTS 3,009,632 A 11/1961 Berger et al.
5,236,311 A 8/1993 Lindstrom
(Continued)

FOREIGN PATENT DOCUMENTS

JP 2018119437 A * 8/2018 ..... F04C 23/02
JP 2020-56508 A 4/2020
WO 2020/067196 A1 4/2020

OTHER PUBLICATIONS

Raw Machine Translation of JP2018-119437; Anzai et.al., "Hermetic Type Compressor and Refrigeration Cycle Device"; Aug. 2, 2018.*

(Continued)

*Primary Examiner* — Essama Omgba
*Assistant Examiner* — Lilya Pekarskaya
(74) *Attorney, Agent, or Firm* — GLOBAL IP COUNSELORS, LLP

(57) ABSTRACT

A compressor device includes first and second compressors. The first and second compressors include first and second casings having bottom portions in which lubricant is to be stored, first and second compression mechanisms provided in the casings to compress refrigerant and discharge the compressed refrigerant into the casings, and first and second motors provided in the casings. The first and second motors each include a stator and a rotor, and drive the first and second compression mechanisms. The second compressor compresses the refrigerant discharged from the first compressor. The first and second motors have first and second passages extending from axial ends of the first and second
(Continued)

motors and through which the refrigerant discharged from the first and second compression mechanisms passes. A cross-sectional area of the second passage is larger than a cross-sectional area of the first passage. A refrigeration apparatus includes the compressor device.

14 Claims, 10 Drawing Sheets

(51) Int. Cl.
*F04C 23/00* (2006.01)
*F04C 23/02* (2006.01)
*F04C 29/02* (2006.01)

(52) U.S. Cl.
CPC ..... *F04C 23/02* (2013.01); *F04C 29/026* (2013.01); *F04C 2240/40* (2013.01); *F04C 2240/809* (2013.01)

(58) Field of Classification Search
CPC .. F04C 2240/809; F04C 29/02; F04C 29/045; F25B 31/026; F25B 2400/23; F25B 43/02; F25B 2400/13; F25B 13/00; F25B 31/004; F25B 41/00; F04B 35/04; F04B 39/0238; F04B 39/0246; F04B 39/0253
See application file for complete search history.

(56) References Cited

U.S. PATENT DOCUMENTS

| | | | | |
|---|---|---|---|---|
| 6,836,051 | B2 * | 12/2004 | Hiwaki | H02K 1/185 310/254.1 |
| 7,164,218 | B2 * | 1/2007 | Kimura | F04C 23/008 310/58 |
| 7,651,322 | B2 | 1/2010 | Shaw | |
| 9,929,607 | B2 * | 3/2018 | Kataoka | F04B 39/0238 |
| 2009/0100861 | A1 * | 4/2009 | Higuchi | F04C 29/028 62/468 |
| 2012/0269667 | A1 * | 10/2012 | Sakima | F04C 29/0021 417/423.7 |
| 2018/0248428 | A1 * | 8/2018 | Nigo | H01F 1/057 |
| 2021/0270271 | A1 * | 9/2021 | Ueda | H02K 5/12 |
| 2021/0310701 | A1 | 10/2021 | Okamoto et al. | |
| 2021/0310702 | A1 * | 10/2021 | Ohnishi | F04C 29/04 |
| 2021/0310703 | A1 | 10/2021 | Ohnishi et al. | |
| 2021/0340981 | A1 | 11/2021 | Okamoto et al. | |
| 2022/0235770 | A1 * | 7/2022 | Yamamoto | F04C 23/008 |

OTHER PUBLICATIONS

International Preliminary Report of corresponding PCT Application No. PCT/JP2022/009068 dated Sep. 28, 2023.
International Search Report of corresponding PCT Application No. PCT/JP2022/009068 dated Apr. 26, 2022.
European Search Report of corresponding EP Application No. 22 77 1124.9 dated Sep. 18, 2024.

* cited by examiner

COMPRESSOR DEVICE AND REFRIGERATION APPARATUS

CROSS-REFERENCE TO RELATED APPLICATIONS

This is a continuation of International Application No. PCT/JP2022/009068 filed on Mar. 3, 2022, which claims priority to Japanese Patent Application No. 2021-042770, filed on Mar. 16, 2021. The entire disclosures of these applications are incorporated by reference herein.

BACKGROUND

Technical Field

The present disclosure relates to a compressor device and a refrigeration apparatus.

Background Art

A compressor device including a plurality of compressors that compress a refrigerant in a plurality of stages has been used for a refrigeration apparatus. Japanese Unexamined Patent Publication No. 2020-56508 discloses a compressor device including two compressors that are connected together in series to compress a refrigerant in two stages.

SUMMARY

A first aspect of the present disclosure is directed to a compressor device. The compressor device includes a first compressor and a second compressor. The first compressor includes a first casing having a bottom portion in which lubricant is to be stored, a first compression mechanism provided in the first casing to compress a refrigerant and discharge the compressed refrigerant into the first casing, and a first motor provided in the first casing. The first motor includes a stator and a rotor, and is configured to drive the first compression mechanism. The second compressor includes a second casing having a bottom portion in which lubricant is to be stored, a second compression mechanism provided in the second casing to compress a refrigerant and discharge the compressed refrigerant into the second casing, and a second motor provided in the second casing. The second motor includes a stator and a rotor, and is configured to drive the second compression mechanism. The second compressor is configured to compress the refrigerant discharged from the first compressor. The first motor has a first passage extending from one axial end to another axial end of the first motor and through which the refrigerant discharged from the first compression mechanism passes. The second motor has a second passage extending from one axial end to another axial end of the second motor and through which the refrigerant discharged from the second compression mechanism passes. A cross-sectional area of the second passage is larger than a cross-sectional area of the first passage.

A refrigeration apparatus includes the compressor device.

DETAILED DESCRIPTION OF EMBODIMENT(S)

First Embodiment

Figure 1:
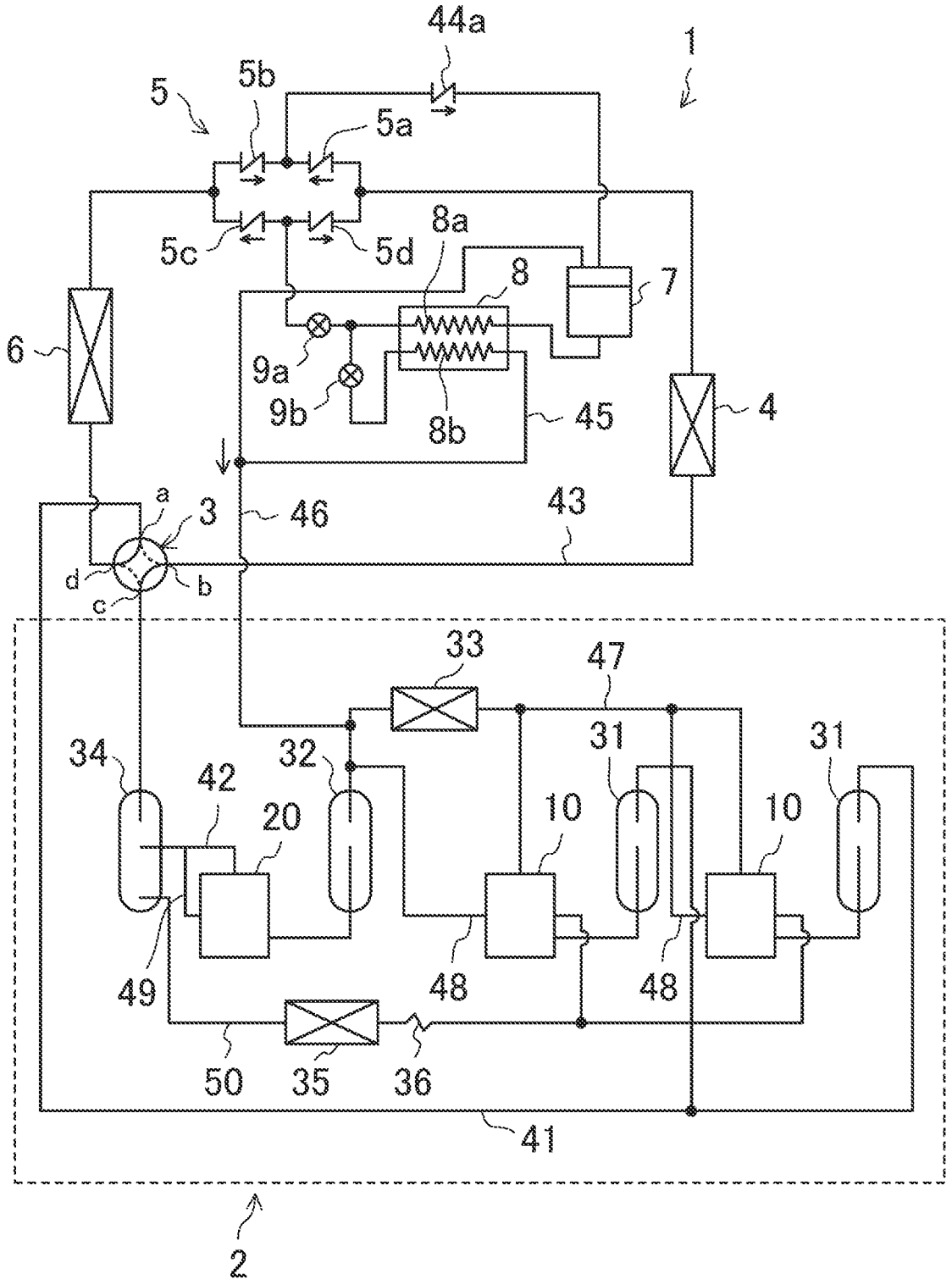
FIG. 1 illustrates a refrigerant circuit of a refrigeration apparatus according to a first embodiment.

A refrigeration apparatus (1) according to a first embodiment uses carbon dioxide as a refrigerant to perform a two-stage compression refrigeration cycle. The refrigeration apparatus (1) can be used for an air conditioner, a water cooler/heater, refrigeration equipment, or any other similar system, for example.

Schematic Configuration of Refrigeration Apparatus

A refrigerant circuit of the refrigeration apparatus (1) includes a compressor device (2), a four-way switching valve (3), a heat-source-side heat exchanger (4), a bridge circuit (5), a utilization-side heat exchanger (6), a receiver (7), an economizer heat exchanger (8), and expansion mechanisms (9*a*, 9*b*).

Although will be described in detail later, the compressor device (2) includes two first compressors (10, 10) and one second compressor (20), which compress a refrigerant in two stages.

The four-way switching valve (3) has first to fourth ports (a to d). The first port (a) is connected through a suction line (41) to the suction-side ends of the two first compressors (10, 10). The third port (c) is connected through a discharge line (42) to the discharge-side end of the second compressor (20). The four-way switching valve (3) has its second and fourth ports (b) and (d) connected together through a main line (43). The main line (43) is connected to the heat-source-side heat exchanger (4), the bridge circuit (5), and the utilization-side heat exchanger (6) in this order from the second port (b) toward the fourth port (d).

The four-way switching valve (3) is switchable to a first mode (mode indicated by the dashed lines in FIG. 1) in which the first port (a) and the second port (b) communicate with each other and the third port (c) and the fourth port (d) communicate with each other, and a second mode (mode indicated by the solid lines in FIG. 1) in which the first port (a) and the fourth port (d) communicate with each other and the second port (b) and the third port (c) communicate with each other. If the four-way switching valve (3) is switched to the first mode, the refrigerant compressed by the compressor device (2) is guided to the utilization-side heat exchanger (6). If the four-way switching valve (3) is switched to the second mode, the refrigerant compressed by the compressor device (2) is guided to the heat-source-side heat exchanger (4).

The bridge circuit (5) includes a first check valve (5*a*), a second check valve (5*b*), a third check valve (5*c*), and a fourth check valve (5*d*). The outlet of the first check valve (5*a*) is connected to the outlet of the second check valve (5*b*). The inlet of the second check valve (5*b*) is connected to the outlet of the third check valve (5*c*). The inlet of the third check valve (5*c*) is connected to the inlet of the fourth check valve (5*d*). The outlet of the fourth check valve (5*d*) is connected to the inlet of the first check valve (5*a*). The outlets of the first and second check valves (5*a*, 5*b*), and the inlets of the third and fourth check valves (5*c*, 5*d*), of the bridge circuit (5) are connected together through the main line (43). The main line (43) is connected to a check valve (44*a*), the receiver (7), the economizer heat exchanger (8), and the expansion mechanism (9*a*) in this order from the outlets of the first and second check valves (5*a*, 5*b*) toward the inlets of the third and fourth check valves (5*c*, 5*d*).

A branch pipe (45) has one end connected to a portion of the main line (43) between the economizer heat exchanger (8) and the expansion mechanism (9*a*), and is connected to the expansion mechanism (9*b*) and the economizer heat exchanger (8) in sequential order. The other end of the branch pipe (45) is connected to an intermediate injection line (46) that connects the receiver (7) and an intermediate pressure line (47) of the compressor device (2) together.

The economizer heat exchanger (8) is configured as, for example, a fin-and-tube heat exchanger. The economizer heat exchanger (8) has a first heat exchange passage (8*a*) forming part of the main line (43) and a second heat exchange passage (8*b*) forming part of the branch pipe (45). In the economizer heat exchanger (8), the high-pressure liquid refrigerant flowing out of the receiver (7) and then flowing through the first heat exchange passage (8*a*) exchanges heat with the refrigerant which has passed through the first heat exchange passage (8*a*), which has flowed through the main line (43) into the branch pipe (45) so as to be decompressed by the expansion mechanism (9*b*), and which flows through the second heat exchange passage (8*b*). As a result, the high-pressure liquid refrigerant is cooled (supercooled). Conversely, in the economizer heat exchanger (8), the refrigerant flowing through the second heat exchange passage (8*b*) exchanges heat with the high-pressure liquid refrigerant flowing through the first heat exchange passage (8*a*), and is thus heated. Although will be described in detail later, the refrigerant heated by the high-pressure liquid refrigerant in the economizer heat exchanger (8) flows into the intermediate injection line (46), and is introduced into the intermediate pressure line (47) through which the refrigerant discharged from the low-stage first compressor (10) of the compressor device (2) flows, together with the gas refrigerant that has flowed out of the receiver (7).

Operation of Refrigeration Apparatus

With this configuration, in the refrigerant circuit of the refrigeration apparatus (1), if the four-way switching valve (3) is switched to the first mode, the refrigerant compressed in the compressor device (2) flows through the utilization-side heat exchanger (6), the receiver (7), the economizer heat exchanger (8), the expansion mechanism (9*a*), and the heat-source-side heat exchanger (4) in this order. Thus, a refrigeration cycle in which the utilization-side heat exchanger (6) serves as a radiator and the heat-source-side heat exchanger (4) serves as an evaporator is performed. On the other hand, in the refrigerant circuit of the refrigeration apparatus (1), if the four-way switching valve (3) is switched to the second mode, the refrigerant compressed in the compressor device (2) flows through the heat-source-side heat exchanger (4), the receiver (7), the economizer heat exchanger (8), the expansion mechanism (9*a*), and the utilization-side heat exchanger (6) in this order. Thus, a refrigeration cycle in which the heat-source-side heat exchanger (4) serves as a radiator and the utilization-side heat exchanger (6) serves as an evaporator is performed.

If the four-way switching valve (3) is in either of the modes, the refrigerant flows through the bridge circuit (5) into the branch pipe (45), is decompressed by the expansion mechanism (9*b*), and then flows into the economizer heat exchanger (8), thus cooling the refrigerant flowing through the main line (43). The refrigerant in the branch pipe (45) that has flowed out of the economizer heat exchanger (8) flows into the intermediate injection line (46), joins the gas refrigerant flowing from the receiver (7) toward the intermediate pressure line (47) of the compressor device (2), and is guided to the intermediate pressure line (47) of the compressor device (2).

Configuration of Compressor Device

The compressor device (2) includes the two first compressors (10, 10), the one second compressor (20), two first accumulators (31, 31), one second accumulator (32), one intercooler (33), one oil separator (34), one oil cooler (35), and one decompressor (36).

The suction sides (suction pipes (15) to be described later) of the two first compressors (10, 10) are connected to the outlet ends of two branches of the suction line (41) near the outlet thereof, respectively. The first accumulators (31) are each connected between the branch point, and an associated one of the two outlet ends, of the suction line (41). The discharge sides (discharge pipes (16) to be described later) of the two first compressors (10, 10) are connected to two inlet ends of the intermediate pressure line (47), respectively.

Two inlet portions of the intermediate pressure line (47) are joined together at an intermediate portion thereof. One outlet end of the intermediate pressure line (47) after this joining is connected to the suction side (a suction pipe (25) to be described later) of the second compressor (20). The joined portion of the intermediate pressure line (47) is connected to the intercooler (33) and the second accumulator (32) in this order from the inlet toward the outlet thereof.

The intercooler (33) is configured as, for example, a fin-and-tube heat exchanger. The intercooler (33) exchanges heat between the refrigerant compressed by the two first compressors (10, 10) and, for example, outside air to cool the refrigerant.

The outlet end of the above-described intermediate injection line (46) is connected to a portion of the intermediate pressure line (47) between the intercooler (33) and the second accumulator (32). The discharge line (42) has one end connected to the third port (c) of the four-way switching valve (3), and the other end connected to the discharge side of the second compressor (20) (a discharge pipe (26) to be described later). An intermediate portion of the discharge line (42) is connected to the oil separator (34).

The two first compressors (10, 10) are each connected to one end of an associated one of oil discharge pipes (48, 48). The other end of each of the two oil discharge pipes (48, 48) is connected to a portion of the intermediate pressure line (47) upstream of the second accumulator (32). Specifically, the other end of one of the oil discharge pipes (48) is connected to the upstream side of the intercooler (33), and the other end of the other oil discharge pipe (48) is connected to the downstream side of the intercooler (33). The two oil discharge pipes (48, 48) are provided to open through casings (11) of the associated first compressors (10) at a predetermined height (the height of the oil surface observed when the lubricant amount is excessive).

One end of an oil discharge pipe (49) is connected to the second compressor (20), and the other end of the oil discharge pipe (49) is connected to a portion of the discharge pipe (42) upstream of the oil separator (34). The oil discharge pipe (49) is provided to open through a casing (21) of the second compressor (20) at a predetermined height (the height of the oil surface observed when the lubricant amount is excessive).

A bottom portion of the oil separator (34) is connected to the inlet end of an oil return pipe (50). The oil return pipe (50) branches into two branches near its outlet, and its two outlet ends are connected to the two first compressors (30, 30), respectively. The oil return pipe (50) is connected to the oil cooler (35) and the decompressor (36) in this order from its inlet toward its outlet.

The oil cooler (35) is configured as, for example, a fin-and-tube heat exchanger. The oil cooler (35) exchanges heat between the lubricant separated from the high-pressure discharged refrigerant in the oil separator (34) and, for example, outside air to cool the lubricant.

The decompressor (36) is configured as, for example, a capillary tube. The decompressor (36) decompresses the high-pressure lubricant cooled in the oil cooler (35). The lubricant decompressed by the decompressor (36) is guided through the oil return pipe (50) to the two first compressors (10, 10).

Operation of Compressor Device

First, a low-pressure refrigerant that has absorbed heat in the evaporator (the heat-source-side heat exchanger (4) or the utilization-side heat exchanger (6)) of the refrigeration apparatus (1) flows through the suction line (41) into the two first accumulators (31, 31). The two first accumulators (31, 31) separate a liquid refrigerant from a gas refrigerant in the low-pressure refrigerant. The gas refrigerant in each first accumulator (31) is sucked into the associated first compressor (10) connected through the suction line (41) to the first accumulator (31). The two first compressors (10, 10) compress the low-pressure refrigerant to an intermediate pressure (a pressure between the high pressure and the low pressure in the refrigerant circuit). The resultant intermediate-pressure refrigerant is discharged.

The flows of the intermediate-pressure refrigerant discharged from the two first compressors (10, 10) join together at the joined portion of the intermediate pressure line (47), and then enter the intercooler (33). The intermediate-pressure refrigerant that has flowed into the intercooler (33) exchanges heat with outside air so as to be cooled, and is guided through the intermediate pressure line (47) to the second accumulator (32). In addition, the intermediate-pressure refrigerant introduced through the intermediate injection line (46) into the intermediate pressure line (47) is introduced into the second accumulator (32). The gas refrigerant introduced through the intermediate injection line (46) into the intermediate pressure line (47) has a lower temperature than the intermediate-pressure refrigerant in the intermediate pressure line (47) does. Thus, injection of the gas refrigerant through the intermediate injection line (46) into the intermediate pressure line (47) lowers the temperature of the intermediate-pressure refrigerant in the intermediate pressure line (47), and thus improves the efficiency of the refrigeration apparatus (1).

The second accumulator (32) separates the liquid refrigerant from the gas refrigerant in the intermediate-pressure refrigerant. The gas refrigerant in the second accumulator (32) is sucked into the second compressor (20) through the intermediate pressure line (47). The second compressor (20) compresses the intermediate-pressure refrigerant to a high pressure. The resultant high-pressure refrigerant is discharged.

The high-pressure refrigerant discharged from the second compressor (20) is guided to the oil separator (34) by the discharge line (42). The oil separator (34) separates, from the high-pressure gas refrigerant, the lubricant contained in the high-pressure gas refrigerant discharged from the second compressor (20). The high-pressure gas refrigerant separated from the lubricant in the oil separator (34) is guided through the discharge line (42) and the four-way switching valve (3) to the radiator (the heat-source-side heat exchanger (4) or the utilization-side heat exchanger (6)).

In the compressor device (2), a surplus of the lubricant in each of the two first compressors (10, 10) is guided to the second accumulator (32) by the associated oil discharge pipe (48, 48), and is sucked into the second compressor (20) together with the intermediate-pressure refrigerant. In contrast, a surplus of the lubricant in the second compressor (20) is guided to the oil separator (34) by the oil discharge pipe (49). The high-pressure lubricant separated from the high-pressure gas refrigerant in the oil separator (34) is guided through the oil return pipe (50) to the oil cooler (35), and exchanges heat with outside air so as to be cooled. The high-pressure lubricant cooled by the oil cooler (35) is decompressed by the decompressor (36), and is guided through the oil return pipe (50) to the two first compressors (10, 10).

Detailed Configuration of Compressors

The first compressors (10) and the second compressor (20) are all swing rotary compressors.

First Compressor

Figure 2:
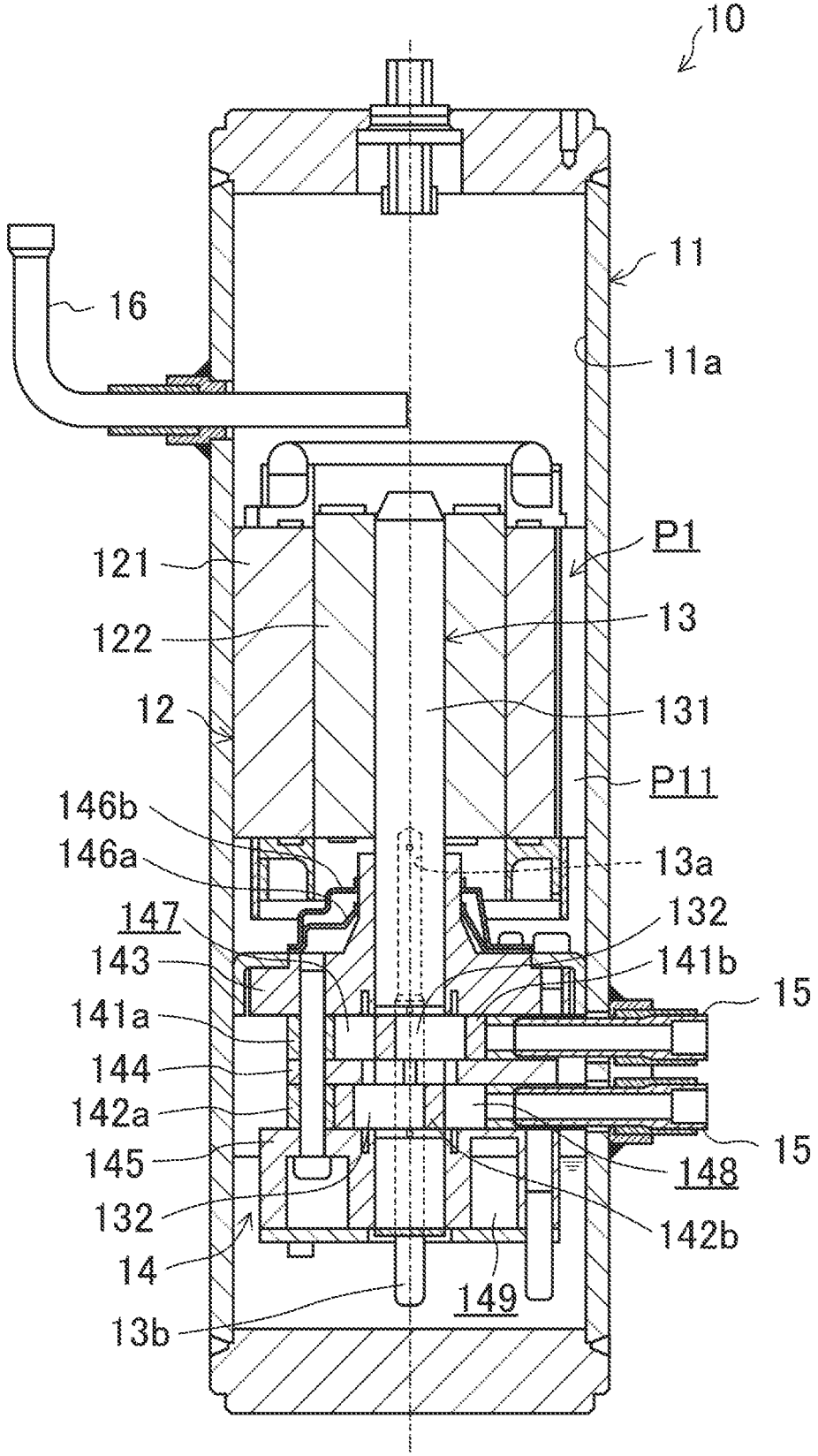
FIG. 2 is a longitudinal sectional view of a first compressor of a compressor device according to the first embodiment.

As illustrated in FIG. 2, each first compressor (10) includes the one casing (first casing) (11), one motor (first motor) (12), one drive shaft (13), one compression mechanism (first compression mechanism) (14), the two suction pipes (15, 15), and the one discharge pipe (first discharge pipe) (16). The compression mechanism (14), the motor (12), and the drive shaft (13) are provided in the casing (11). The suction pipes (15) and the discharge pipe (16) are provided to run through the casing (11) from the inside toward the outside of the casing (11).

The casing (11) is formed in the shape of a vertically oriented substantial cylinder. The casing (11) is configured to be able to withstand the intermediate pressure during operation of the refrigeration apparatus (1). The bottom portion of the casing (11) stores the lubricant.

The motor (12) is a brushless DC motor. The motor (12) includes a stator (121) and a rotor (122). The outer periphery of the stator (121) of the motor (12) is fixed to the inner surface (11*a*) of a sidewall portion of the casing (11). The motor (12) is provided at an intermediate height in the top-to-bottom direction inside the casing (11).

Figure 4:
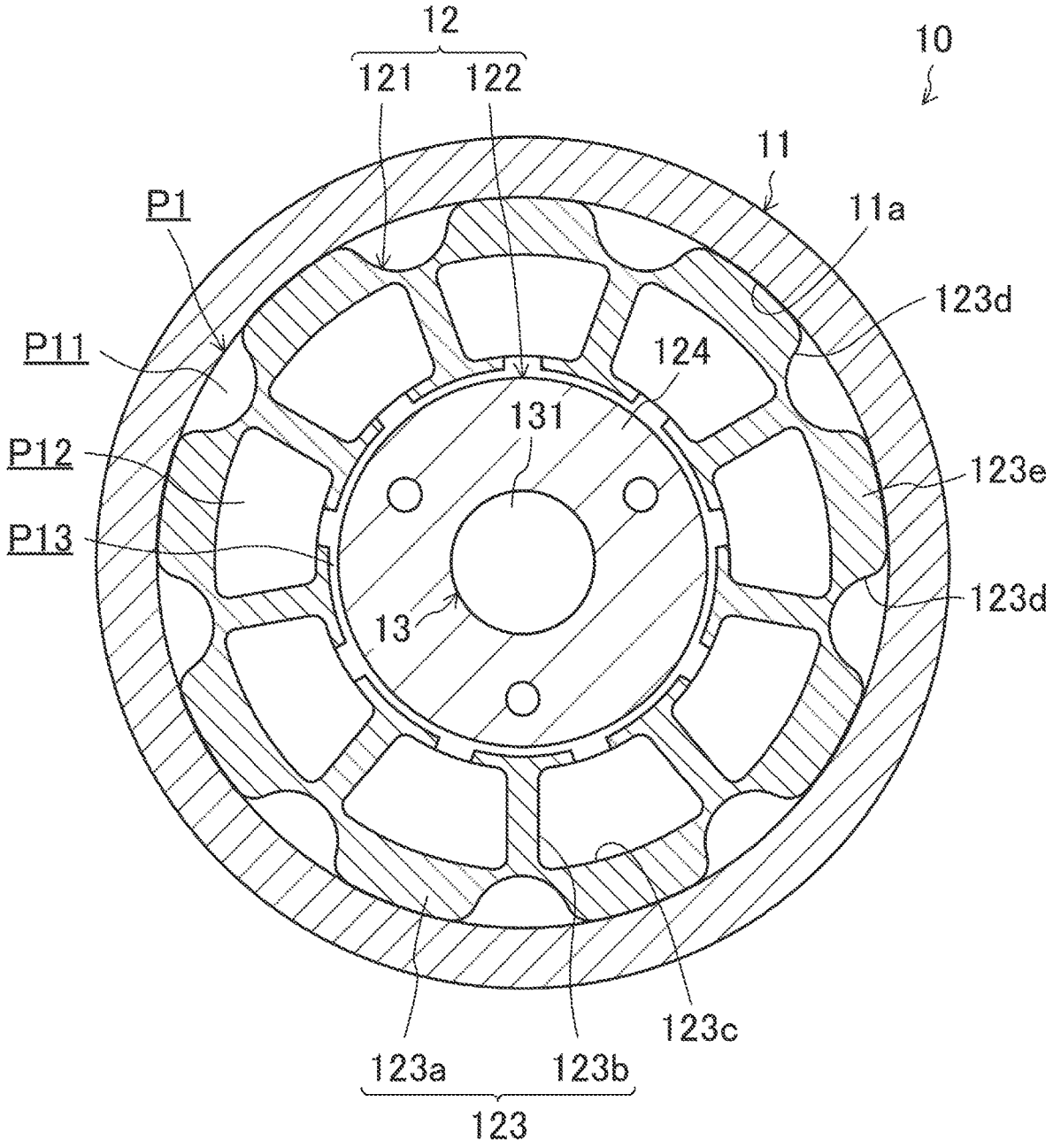
FIG. 4 is a transverse sectional view of a motor portion of the first compressor of the compressor device according to the first embodiment.

As illustrated in FIG. 4, the stator (121) includes a stator core (123) and coils (not shown). The stator core (123) includes a cylindrical core back (123*a*), and a plurality of (in this first embodiment, nine) teeth (123*b*, . . . , 123*b*) protruding radially inward from an inner peripheral surface of the core back (123*a*).

The plurality of teeth (123*b*, . . . , 123*b*) define slots (123*c*) equal in number to the teeth (123*b*, . . . , 123*b*) inside the core back (123*a*) of the stator core (123). Each of the slots (123*c*) is arranged between an associated adjacent pair of the teeth (123*b*), and includes one of the coils. Meanwhile, the outer periphery of the core back (123*a*) of the stator core (123) has a plurality of core cuts (123*d*, . . . , 123*d*). The core cuts (123*d*) are grooves each formed by cutting away a portion of the stator core (123) from the upper end surface to the lower end surface of the stator core (123). The number of the core cuts (123*d*) formed is nine so that the core cuts (123*d*) correspond to the nine teeth (123*b*, . . . , 123*b*). The core back (123*a*) has nine protrusions (123*e*) formed by the nine core cuts (123*d*, . . . , 123*d*) and protruding outward. The nine protrusions (123*e*, . . . , 123*e*) are fixed to the inner surface (11*a*) of the sidewall portion of the casing (11) by welding or any other process.

The rotor (122) includes a cylindrical rotor core (124) and permanent magnets (not shown). The rotor core (124) is fixed to an upper portion of the drive shaft (13), and is disposed inside the stator core (123) with a gap therebetween. The rotor (122) rotates through magnetic interaction with the stator (121), resulting in rotation of the drive shaft (13).

The motor (12) has a gas passage (first passage) (P1) which extends from one axial end to the other axial end thereof and through which the refrigerant (discharged refrigerant) discharged from the compression mechanism (14) toward the discharge pipe (16) passes. The gas passage (P1) will be described in detail later.

The drive shaft (13) has a main shaft portion (131) and two eccentric portions (132, 132). The main shaft portion (131) is provided in the cylindrical casing (11) such that their center axes coincide with each other. The rotor (122) of the motor (12) is fixed to an upper portion of the main shaft portion (131). The two eccentric portions (132, 132) are spaced apart from each other in the top-to-bottom direction on a lower portion of the main shaft portion (131). The drive shaft (13) has therein an oil supply passage (13*a*) through which the lubricant is to be supplied to sliding portions of the compression mechanism (14). The lower end of the drive shaft (13) is provided with an oil tube (13*b*) for drawing the lubricant stored in the bottom portion of the casing (11) to the oil supply passage (13*a*).

The compression mechanism (14) is a two-cylinder compression mechanism. The compression mechanism (14) includes a first cylinder (141*a*), a first piston (141*b*), a second cylinder (142*a*), a second piston (142*b*), a front head (143), a middle plate (144), a rear head (145), and front mufflers (146*a*, 146*b*). In the compression mechanism (14), the front head (143), the first cylinder (141*a*), the middle plate (144), the second cylinder (142*a*), and the rear head (145) are stacked in this order from the top toward the bottom, and are fixed together through bolts or any other element. The outer periphery of the front head (143) that rotatably supports the main shaft portion (131) of the drive shaft (13) is fixed to the inner surface (11*a*) of the casing (11). Thus, the compression mechanism (14) is provided inside a lower portion of the casing (11).

The first piston (141*b*) is provided inside the first cylinder (141*a*), and the upper eccentric portion (132) of the drive shaft (13) is fitted into the first piston (141*b*). Rotation of the drive shaft (13) causes the first piston (141*b*) to revolve along the inner peripheral surface of the first cylinder (141*a*) inside a first compression chamber (147) surrounded by the front head (143), the first cylinder (141*a*), and the middle plate (144). Thus, in the first compression chamber (147), the volumes of a low-pressure chamber and a high-pressure chamber vary, and the refrigerant is compressed.

The second piston (142*b*) is provided inside the second cylinder (142*a*), and the lower eccentric portion (132) of the drive shaft (13) is fitted into the second piston (142*b*). Rotation of the drive shaft (13) causes the second piston (142*b*) to revolve along the inner peripheral surface of the second cylinder (142*a*) inside a second compression chamber (148) surrounded by the middle plate (144), the second cylinder (142*a*), and the rear head (145). Thus, in the second compression chamber (148), the volumes of a low-pressure chamber and a high-pressure chamber vary, and the refrigerant is compressed.

The front head (143) has a discharge passage (not shown) through which the refrigerant compressed in the first compression chamber (147) below the front head (143) is discharged upward. The front mufflers (146*a*, 146*b*) are fixed to an upper surface of the front head (143). The front mufflers (146*a*, 146*b*) each have a discharge hole that allows the refrigerant to pass therethrough. The refrigerant compressed in the first compression chamber (147) is discharged through the discharge passage into a space between the front head (143) and the lower front muffler (146*a*), and is then discharged through the discharge hole of the lower front muffler (146*a*) into a space between the two front mufflers (146*a*, 146*b*). The refrigerant discharged into the space between the two front mufflers (146*a*, 146*b*) is discharged through the discharge hole of the upper front muffler (146*b*) into a space below the motor (12) in the casing (11).

The rear head (145) has a rear muffler space (149) into which the refrigerant compressed in the second compression chamber (148) is discharged. The rear muffler space (149) communicates with the space between the front head (143) and the lower front muffler (146*a*) through a discharge hole (not shown) that runs through the stacked front head (143), first cylinder (141*a*), middle plate (144), second cylinder (142*a*), and rear head (145) in the top-to-bottom direction. The refrigerant compressed in the second compression chamber (148) is discharged into the rear muffler space (149), then flows through the discharge hole into the space between the front head (143) and the lower front muffler (146*a*), and is discharged into the space below the motor (12) in the casing (11) together with the refrigerant discharged from the first compression chamber (147).

The two suction pipes (15, 15) are provided at the lower portion of the casing (11) to run through the sidewall portion of the casing (11) from the inside toward the outside of the casing (11). The upper suction pipe (15) is provided to run through the first cylinder (141*a*), and guides the low-pressure refrigerant to the low-pressure chamber of the first compression chamber (147). The lower suction pipe (15) is provided to run through the second cylinder (142*a*), and guides the low-pressure refrigerant to the low-pressure chamber of the second compression chamber (148).

The discharge pipe (16) is provided at the upper portion of the casing (11) to run through the sidewall portion of the casing (11) from the inside toward the outside of the casing (11). The discharge pipe (16) extends toward the centerline of the casing (11) in the casing (11) such that its entrance end opens near the center of the interior of the casing (11) (near the centerline of the casing (11)). The discharge pipe (16) guides the refrigerant which has been discharged from the compression mechanism (14) into the space below the motor (12) and which has passed through the gas passage (P1) of the motor (12) to reach a space above the motor (12), to the outside of the casing (11) (the intermediate pressure line (47) connected to the discharge pipe (16)).

Second Compressor

Figure 3:
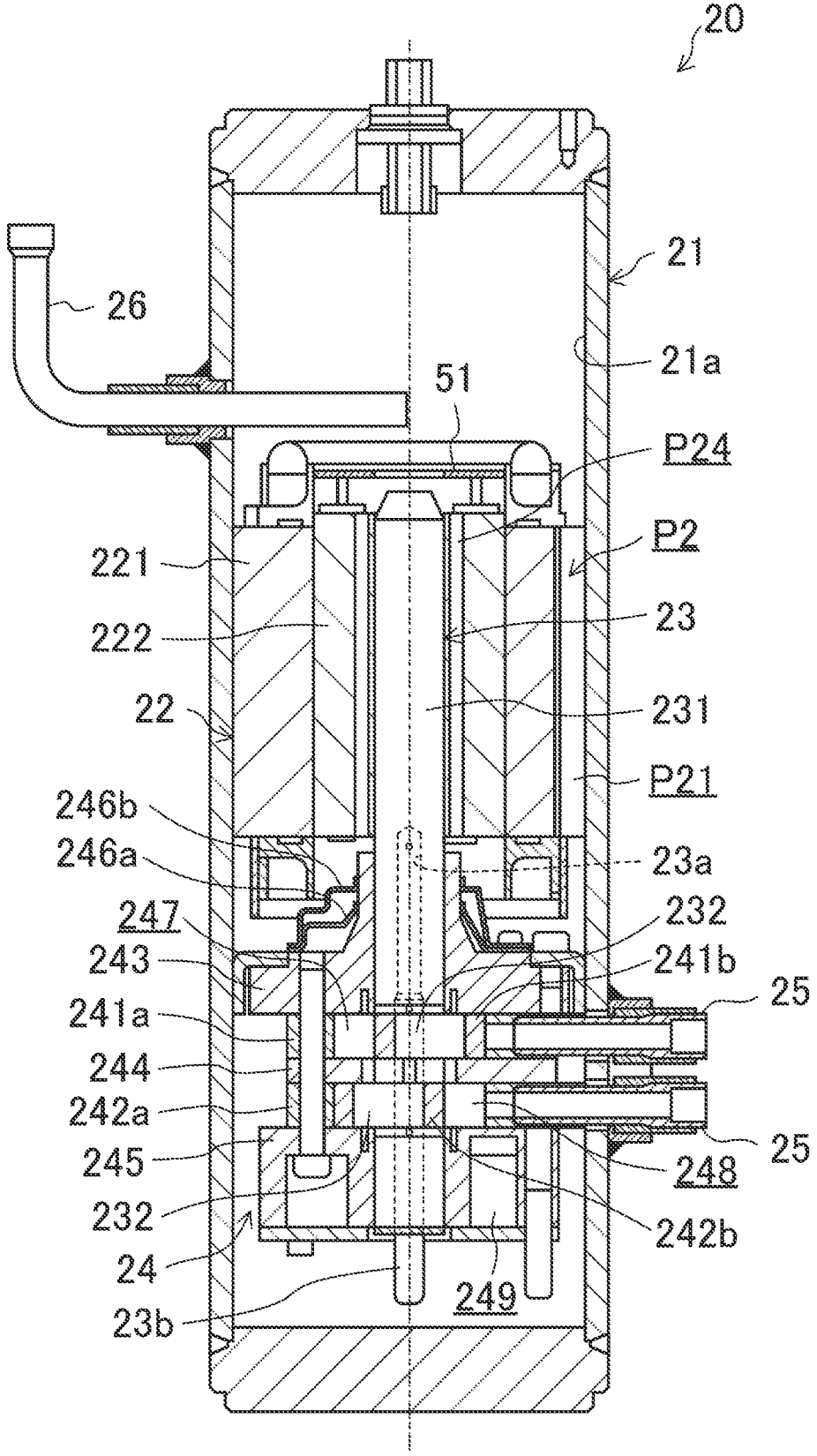
FIG. 3 is a longitudinal sectional view of a second compressor of the compressor device according to the first embodiment.

As illustrated in FIG. 3, the second compressor (20) has a configuration that is generally the same as, or similar to, that of the first compressor (10), and includes the one casing (second casing) (21), one motor (second motor) (22), one drive shaft (23), one compression mechanism (second compression mechanism) (24), the two suction pipes (25, 25), and the one discharge pipe (second discharge pipe) (26). The second compressor (20) includes an oil separation mechanism (51), which is not provided in the first compressor (10). The compression mechanism (24), the motor (22), the drive shaft (23), and the oil separation mechanism (51) are provided in the casing (21), and the suction pipes (25) and the discharge pipe (26) are provided to run through the casing (21) from the inside toward the outside of the casing (21).

The casing (21) is formed in the shape of a vertically oriented substantial cylinder. The casing (21) is configured to be able to withstand the high pressure during operation of the refrigeration apparatus (1). The bottom portion of the casing (21) stores the lubricant.

The motor (22) is a brushless DC motor. The motor (22) includes a stator (221) and a rotor (222). The outer periphery of the stator (221) of the motor (22) is fixed to the inner surface (21*a*) of a sidewall portion of the casing (21). The motor (22) is provided at an intermediate height in the top-to-bottom direction inside the casing (21).

Figure 5:
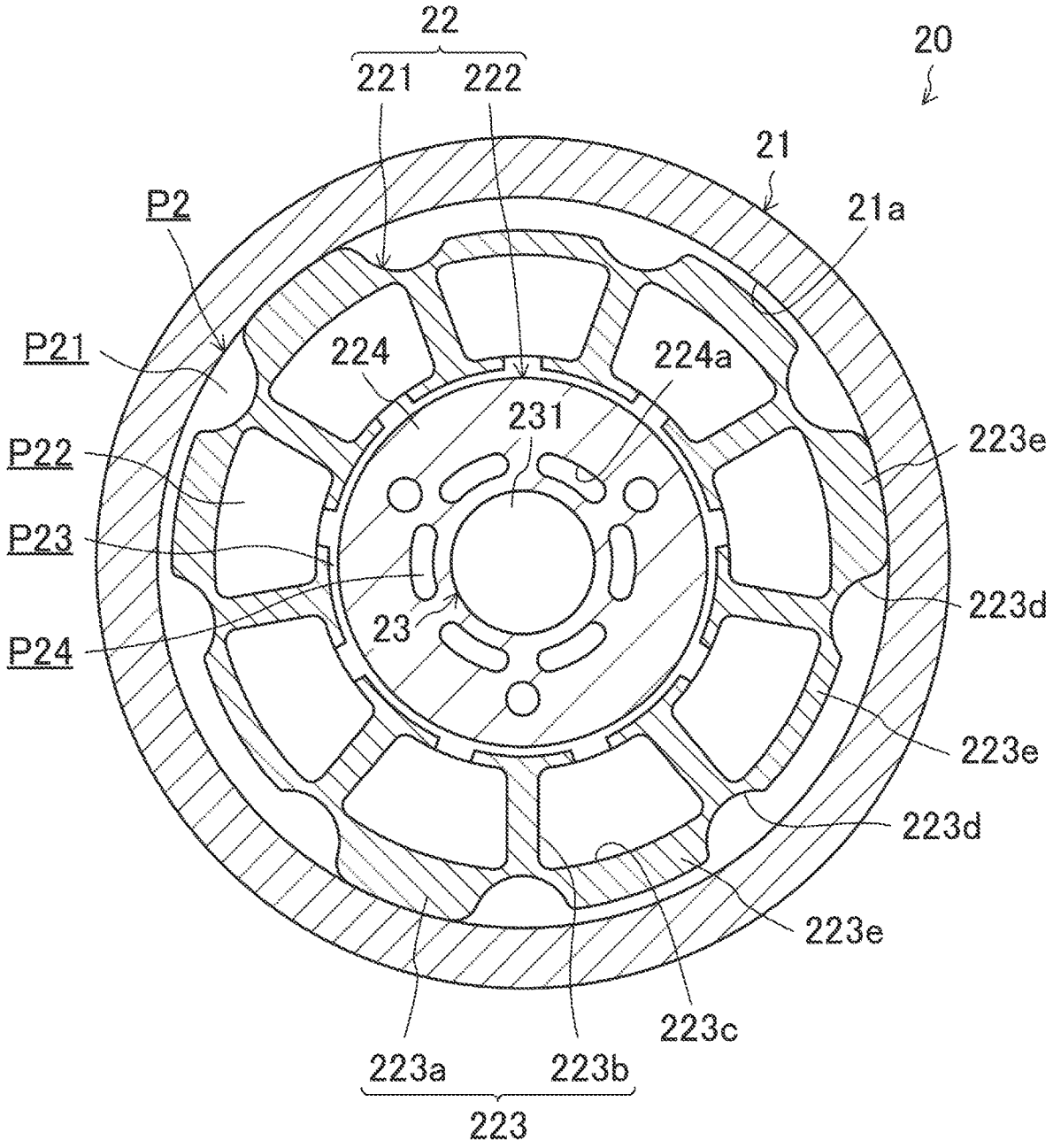
FIG. 5 is a transverse sectional view of a motor portion of the second compressor of the compressor device according to the first embodiment.

As illustrated in FIG. 5, the stator (221) includes a stator core (223) and coils (not shown). The stator core (223) includes a cylindrical core back (223*a*), and a plurality of (in this first embodiment, nine) teeth (223*b*, . . . , 223*b*) protruding radially inward from an inner peripheral surface of the core back (223*a*).

The plurality of teeth (223*b*, . . . , 223*b*) define slots (223*c*) equal in number to the teeth (223*b*, . . . , 223*b*) inside the core back (223*a*) of the stator core (223). Each of the slots (223*c*) is arranged between an associated adjacent pair of the teeth (223*b*), and includes one of the coils. Meanwhile, the outer periphery (core back (223*a*)) of the stator core (223) has a plurality of core cuts (223*d*, . . . , 223*d*). The core cuts (223*d*) are grooves each formed by cutting away a portion of the stator core (223) from the upper end surface to the lower end surface of the stator core (223). The number of the core cuts (223*d*) formed is nine so that the core cuts (223*d*) correspond to the nine teeth (223*b*, . . . , 223*b*). The core back (223*a*) has nine protrusions (223*e*) formed by the nine core cuts (223*d*, . . . , 223*d*) and protruding outward.

In the second compressor (20), only every third one of the nine protrusions (223*e*, . . . , 223*e*) (i.e., three (223*e*, 223*e*, 223*e*) of these nine protrusions) is fixed to the inner surface (21*a*) of the sidewall portion of the casing (21) by welding or any other process. In the second compressor (20), distal end portions of the remaining six protrusions (223*e*, . . . , 223*e*) are cut away to form gaps between the protrusions and the inner surface (21*a*) of the sidewall portion of the casing (21).

The rotor (222) includes a cylindrical rotor core (224) and permanent magnets (not shown). The rotor core (224) is fixed to an upper portion of the drive shaft (13), and is disposed inside the stator core (223) with a gap therebetween. The rotor (222) rotates through magnetic interaction with the stator (221) to rotate the drive shaft (23).

An inner peripheral portion of the rotor core (224) of the second compressor (20) has a plurality of (in this first embodiment, six) holes (224*a*, . . . , 224*a*). Each of the holes (224*a*) is a through hole extending from the upper end surface to the lower end surface of the rotor core (224). In this first embodiment, the hole (224*a*) has a cross section with a circumferential length greater than its radial length. The plurality of holes (224*a*, . . . , 224*a*) are equally spaced on the circumference of the same circle on the inner peripheral portion of the rotor core (224).

The motor (22) has a gas passage (second passage) (P2) which extends from one axial end to the other axial end thereof and through which the refrigerant (discharged refrigerant) discharged from the compression mechanism (24) toward the discharge pipe (26) passes. The gas passage (P2) will be described in detail later.

The drive shaft (23) has a main shaft portion (231) and two eccentric portions (232, 232). The main shaft portion (231) is provided in the cylindrical casing (21) such that their center axes coincide with each other. The rotor (222) of the motor (22) is fixed to an upper portion of the main shaft portion (231). The two eccentric portions (232, 232) are spaced apart from each other in the top-to-bottom direction on a lower portion of the main shaft portion (231). The drive shaft (23) has therein an oil supply passage (23*a*) through which the lubricant is to be supplied to sliding portions of the compression mechanism (24). The lower end of the drive shaft (23) is provided with an oil tube (23*b*) for drawing the lubricant stored in the bottom portion of the casing (21) to the oil supply passage (23*a*).

The compression mechanism (24) is a two-cylinder compression mechanism. The compression mechanism (24) includes a first cylinder (241*a*), a first piston (241*b*), a second cylinder (242*a*), a second piston (242*b*), a front head (243), a middle plate (244), a rear head (245), and front mufflers (246*a*, 246*b*). In the compression mechanism (24), the front head (243), the first cylinder (241*a*), the middle plate (244), the second cylinder (242*a*), and the rear head (245) are stacked in this order from the top toward the bottom, and are fixed together through bolts or any other element. The outer periphery of the front head (243) that rotatably supports the main shaft portion (231) of the drive shaft (23) is fixed to the inner surface (21*a*) of the casing (21). Thus, the compression mechanism (24) is provided inside a lower portion of the casing (21).

The first piston (241*b*) is provided inside the first cylinder (241*a*), and the upper eccentric portion (232) of the drive shaft (23) is fitted into the first piston (241*b*). Rotation of the drive shaft (23) causes the first piston (241*b*) to revolve along the inner peripheral surface of the first cylinder (241*a*) inside a first compression chamber (247) surrounded by the front head (243), the first cylinder (241*a*), and the middle plate (244). Thus, in the first compression chamber (247), the volumes of a low-pressure chamber and a high-pressure chamber vary, and the refrigerant is compressed.

The second piston (242*b*) is provided inside the second cylinder (242*a*), and the lower eccentric portion (232) of the drive shaft (23) is fitted into the second piston (242*b*). Rotation of the drive shaft (23) causes the second piston (242*b*) to revolve along the inner peripheral surface of the second cylinder (242*a*) inside a second compression chamber (248) surrounded by the middle plate (244), the second cylinder (242*a*), and the rear head (245). Thus, in the second compression chamber (248), the volumes of a low-pressure chamber and a high-pressure chamber vary, and the refrigerant is compressed.

The front head (243) has a discharge passage (not shown) through which the refrigerant compressed in the first compression chamber (247) below the front head (243) is discharged upward. The front mufflers (246*a*, 246*b*) are fixed to an upper surface of the front head (243). The front mufflers (246*a*, 246*b*) each have a discharge hole that allows the refrigerant to pass therethrough. The refrigerant compressed in the first compression chamber (247) is discharged through the discharge passage into a space between the front head (243) and the lower front muffler (246*a*), and is then discharged through the discharge hole of the lower front muffler (246*a*) into a space between the two front mufflers (246*a*, 246*b*). The refrigerant discharged into the space between the two front mufflers (246*a*, 246*b*) is discharged through the discharge hole of the upper front muffler (246*b*) into a space below the motor (22) in the casing (21).

The rear head (245) has a rear muffler space (249) into which the refrigerant compressed in the second compression chamber (248) is discharged. The rear muffler space (249) communicates with the space between the front head (243) and the lower front muffler (246*a*) through a discharge hole (not shown) that runs through the stacked front head (243), first cylinder (241*a*), middle plate (244), second cylinder (242*a*), and rear head (245) in the top-to-bottom direction. The refrigerant compressed in the second compression chamber (248) is discharged into the rear muffler space (249), then flows through the discharge hole into the space between the front head (243) and the lower front muffler (246*a*), and is discharged into the space below the motor (22) in the casing (21) together with the refrigerant discharged from the first compression chamber (247).

The two suction pipes (25, 25) are provided at the lower portion of the casing (21) to run through the sidewall portion of the casing (21) from the inside toward the outside of the casing (21). The upper suction pipe (25) is provided to run through the first cylinder (241*a*), and guides the low-pressure refrigerant to the low-pressure chamber of the first compression chamber (247). The lower suction pipe (25) is provided to run through the second cylinder (242*a*), and guides the low-pressure refrigerant to the low-pressure chamber of the second compression chamber (248).

The discharge pipe (26) is provided at the upper portion of the casing (21) to run through the sidewall portion of the casing (21) from the inside toward the outside of the casing (21). The discharge pipe (26) extends toward the centerline of the casing (21) in the casing (21) such that its inlet end opens near the center of the interior of the casing (21) (near the centerline of the casing (21)). The discharge pipe (26) guides the refrigerant which has been discharged from the compression mechanism (24) into the space below the motor (22) and which has passed through the gas passage (P2) of the motor (22) to reach a space above the motor (22), to the outside of the casing (21) (the discharge line (42) connected to the discharge pipe (26)).

Figure 6:
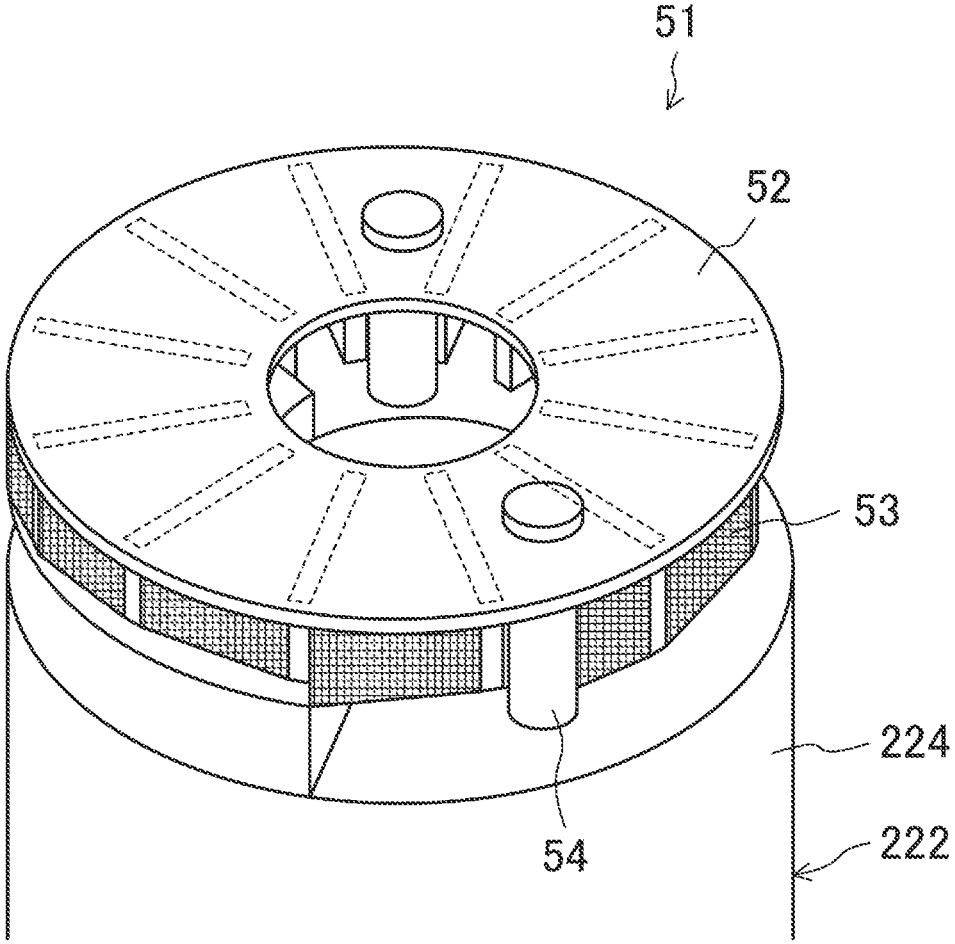
FIG. 6 is a perspective view of an oil separation mechanism provided in the second compressor of the compressor device according to the first embodiment.

The oil separation mechanism (51) is positioned between the gas passage (P2) and the discharge pipe (26) in the top-to-bottom direction (the axial direction of the drive shaft (23)) inside the casing (21). Specifically, in this first embodiment, the oil separation mechanism (51) is fixed to an upper surface of the rotor core (224) of the rotor (222). As illustrated in FIG. 6, the oil separation mechanism (51) includes an oil separation plate (52) and a filter (53). The oil separation plate (52) is formed as a plate-like member having a planar shape equal to that of the upper surface of the rotor core (224). The oil separation plate (52) is arranged parallel to the upper surface of the rotor core (224) so as to be located above the upper surface of the rotor core (224) by a support (54). The filter (53) is provided between the lower surface of the oil separation plate (52) and the upper surface of the rotor core (224) to cover the outer peripheral surface of a doughnut-shaped space defined between the lower surface of the oil separation plate (52) and the upper surface of the rotor core (224).

Gas Passages

In each of the first, second compressors (10), (20), the motor (12, 22) has the gas passage (P1, P2) which extends from the upper end surface toward the lower end surface thereof (from one axial end to the other axial end) and through which the refrigerant discharged from the compression mechanism (14, 24) toward the discharge pipe (16, 26) passes.

In the first embodiment, the gas passages (P1, P2) are formed such that the cross-sectional area of the gas passage (second gas passage) (P2) of the second compressor (20) is larger than that of the gas passage (first gas passage) (P1) of the first compressor (10). The gas passage (P1) of the first compressor (10), the gas passage (P2) of the second compressor (20), and the size relationship between the cross-sectional areas of the gas passages (P1, P2) of the first and second compressors (10, 20) will now be described in detail.

Gas Passage of First Compressor

The gas passage (P1) of the first compressor (10) includes a stator passage (first stator passage) (P11), a tooth-to-tooth passage (P12), and a core-to-core passage (P13).

The stator passage (P11) extends from the upper end surface toward the lower end surface (from one axial end toward the other axial end) of the stator (121) between the stator (121) and the casing (11). Specifically, the stator passage (P11) is configured as a plurality of (in this first embodiment, nine) passages formed between the outer peripheral surface of the stator core (123) and the inner surface (11*a*) of the sidewall portion of the casing (11) by the plurality of (in this first embodiment, nine) core cuts (123*d*, . . . , 123*d*).

The tooth-to-tooth passage (P12) is configured as a plurality of (in this first embodiment, nine) passages each extending from the upper end surface toward the lower end surface (from one axial end toward the other axial end) of the stator core (123) between an associated adjacent pair of the plurality of (in this first embodiment, nine) teeth (123*b*, . . . , 123*b*) of the stator core (123).

The core-to-core passage (P13) extends from the upper end surface toward the lower end surface (from one axial end toward the other axial end) of the stator (121) between the stator (121) and the rotor (122). Specifically, the core-to-core passage (P13) is configured as a cylindrical passage formed between the inner peripheral surface of the stator core (123) (the distal end surfaces of the plurality of (in this first embodiment, nine) teeth (123*b*, . . . , 123*b*)) and the outer peripheral surface of the rotor core (124).

In this first embodiment, the stator passage (P11), the tooth-to-tooth passage (P12), and the core-to-core passage (P13) each have a passage cross-sectional area (an area of a cross section perpendicular to the axial direction of the drive shaft (13)) that is uniform from the upper end to the lower end (one axial end to the other axial end) thereof. Thus, in this first embodiment, the passage cross-sectional area (the area of the cross section perpendicular to the axial direction of the drive shaft (13)) of the gas passage (P1) of the first compressor (10) is also uniform from the upper end to the lower end (one axial end to the other axial end) of the gas passage (P1).

Gas Passage of Second Compressor

The gas passage (P2) of the second compressor (20) includes a stator passage (second stator passage) (P21), a tooth-to-tooth passage (P22), a core-to-core passage (P23), and a rotor passage (P24).

The stator passage (P21) extends from the upper end surface toward the lower end surface (from one axial end toward the other axial end) of the stator (221) between the stator (221) and the casing (21). Specifically, the stator passage (P21) is configured as a plurality of (in this first embodiment, three) passages. These passages are formed between the outer peripheral surface of the stator core (223) and the inner surface (21*a*) of the sidewall portion of the casing (21) by the plurality of (in this first embodiment, nine) core cuts (223*d*, . . . , 223*d*) and a plurality of cutouts obtained by cutting away distal end portions of a plurality of (in this first embodiment, six) ones of the protrusions (223*e*, . . . , 223*e*).

The tooth-to-tooth passage (P22) is configured as a plurality of (in this first embodiment, nine) passages each extending from the upper end surface toward the lower end surface (from one axial end toward the other axial end) of the stator core (223) between an associated adjacent pair of the plurality of (in this first embodiment, nine) teeth (223*b*, . . . , 223*b*) of the stator core (223).

The core-to-core passage (P23) extends from the upper end surface toward the lower end surface (from one axial end toward the other axial end) of the stator (221) between the stator (221) and the rotor (222). Specifically, the core-to-core passage (P23) is configured as a cylindrical passage formed between the inner peripheral surface of the stator core (223) (the distal end surfaces of the plurality of (in this first embodiment, nine) teeth (223*b*, . . . , 223*b*)) and the outer peripheral surface of the rotor core (224).

The rotor passage (P24) extends from the upper end surface toward the lower end surface (from one axial end toward the other axial end) of the rotor (222). Specifically, the rotor passage (P24) is configured as a plurality of (in this first embodiment, six) passages formed inside the rotor core (224) by the plurality of (in this first embodiment, six) holes (224*a*, . . . , 224*a*) of the inner peripheral portion of the rotor core (224).

In this first embodiment, the stator passage (P21), the tooth-to-tooth passage (P22), the core-to-core passage (P23), and the rotor passage (P24) each have a passage cross-sectional area (an area of a cross section perpendicular to the axial direction of the drive shaft (23)) that is uniform from the upper end to the lower end (one axial end to the other axial end) thereof. Thus, in this first embodiment, the passage cross-sectional area (the area of the cross section perpendicular to the axial direction of the drive shaft (23)) of the gas passage (P2) of the second compressor (20) is also uniform from the upper end to the lower end (one axial end to the other axial end) thereof.

Size Relationship in Cross-Sectional Area Between Gas Passages

As described above, in the first embodiment, the cross-sectional area (the area of the cross section perpendicular to the axial direction of the drive shaft (23)) of the gas passage (P2) of the second compressor (20) is larger than the cross-sectional area (the area of the cross section perpendicular to the axial direction of the drive shaft (13)) of the gas passage (P1) of the first compressor (10).

Specifically, in the first embodiment, the passage cross-sectional area of the tooth-to-tooth passage (P12) formed in the first compressor (10) is equal to that of the tooth-to-tooth passage (P22) formed in the second compressor (20), and the passage cross-sectional area of the core-to-core passage (P13) formed in the first compressor (10) is equal to that of the core-to-core passage (P23) formed in second compressor (20).

In contrast, the passage cross-sectional area of the stator passage (P21) formed in the second compressor (20) is larger than that of the stator passage (P11) formed in the first compressor (10). Specifically, as illustrated in FIGS. 4 and 5, the motors (12, 22) of the first and second compressors (10) and (20) each include the stator core (123, 223). These stator cores (123, 223) have the same outside diameter, and each have the core cuts (123*d*, 223*d*) that are the same as, or similar to, one another. Meanwhile, six (223*e*, . . . , 223*e*) of the nine protrusions (223*e*, . . . , 223*e*) formed between adjacent ones of the nine core cuts (223*d*, . . . , 223*d*) for only the second compressor (20) have their distal end portions cut away. In this manner, in the first embodiment, the passage cross-sectional area of the stator passage (P21) formed in the second compressor (20) is larger than that of the stator passage (P11) formed in the first compressor (10).

In the first embodiment, only the gas passage (P2) of the second compressor (20) includes the rotor passage (P24), and the gas passage (P1) of the first compressor (10) includes no rotor passage. Specifically, only the rotor core (224) of the second compressor (20) has the plurality of (in this first embodiment, six) holes (224*a*, . . . , 224*a*), and the rotor core (124) of the first compressor (10) does not have holes serving as rotor passages.

Forming the gas passages (P1, P2) in the first and second compressors (10, 20) in the foregoing manner allows the cross-sectional area of the gas passage (P2) of the second compressor (20) to be larger than that of the gas passage of the first compressor (10) in the first embodiment. That is to say, in the first embodiment, the gas passages (P1, P2) are formed such that the cross-sectional area of the stator passage (P21) of the second compressor (20) is larger than that of the stator passage (P11) of the first compressor (10) and such that only the gas passage (P2) of the second compressor (20) includes the rotor passage (P24). This allows the cross-sectional area of the gas passage (P2) of the second compressor (20) to be larger than that of the gas passage (P1) of the first compressor (10).

Operation of Compressors

Operation of First Compressor

If, in the first compressor (10), the drive shaft (13) is driven and rotated by the motor (12), the first and second pistons (141*b*, 142*b*) revolve inside the first and second cylinders (141*a*, 142*a*), respectively, and the low-pressure refrigerant in the refrigerant circuit is sucked through the two suction pipes (15, 15) into the first and second compression chambers (147, 148) of the compression mechanism (14). The revolutions of the first and second pistons (141*b*, 142*b*) cause the refrigerant sucked into the first and second compression chambers (147, 148) to be compressed, and to be discharged from the compression mechanism (14) into the space below the motor (12) in the casing (11).

The refrigerant discharged into the space below the motor (12) in the casing (11) passes (rises) through the gas passage (P1) formed in the motor (12), and flows out into the space above the motor (12) in the casing (11). The refrigerant that has flowed out into the space above the motor (12) in the casing (11) is discharged through the discharge pipe (16) to the outside of the first compressor (10) (the intermediate pressure line (47)).

During the operation of the first compressor (10), the lubricant stored in the bottom portion of the casing (11) is drawn up to the oil supply passage (13*a*) by the oil tube (13*b*), and is supplied to the sliding portions of the compression mechanism (14). Since the intermediate-pressure refrigerant that has been compressed by the compression mechanism (14) is discharged, the inside of the casing (11) of the first compressor (10) has an intermediate pressure equivalent to the pressure of the discharged refrigerant. Thus, a portion of the lubricant supplied to the sliding portions flows into the low-pressure chambers of the first and second compression chambers (147, 148), is compressed together with the refrigerant, and is then discharged into the space below the motor (12) in the casing (11) together with the refrigerant.

Relatively large-diameter ones of drops of the lubricant discharged into the space below the motor (12) in the casing (11) together with the refrigerant are subjected to the gravity force larger than the force received from the refrigerant which has been discharged from the compression mechanism (14) and which flows toward the discharge pipe (16), and thus fall to return to the bottom portion of the casing (11). Meanwhile, relatively small-diameter ones of the drops receive a larger force from the refrigerant than the gravity force, then pass (rise) through the gas passage (P1) together with the refrigerant, and are discharged through the discharge pipe (16) to the outside of the first compressor (10) (the intermediate pressure line (47)) together with the refrigerant.

Operation of Second Compressor

If, in the second compressor (20), the drive shaft (23) is driven and rotated by the motor (22), the first and second pistons (241*b*, 242*b*) revolve inside the first and second cylinders (241*a*, 242*a*), respectively, and the low-pressure refrigerant in the refrigerant circuit is sucked through the two suction pipes (25, 25) into the first and second compression chambers (247, 248) of the compression mechanism (24). The revolutions of the first and second pistons (241*b*, 242*b*) cause the refrigerant sucked into the first and second compression chambers (247, 248) to be compressed, and to be discharged from the compression mechanism (24) into the space below the motor (22) in the casing (21).

The refrigerant discharged into the space below the motor (22) in the casing (21) passes (rises) through the gas passage (P2) formed in the motor (22), and flows out into the space above the motor (22) in the casing (21). The refrigerant that has flowed out into the space above the motor (22) in the casing (21) is discharged through the discharge pipe (26) to the outside of the second compressor (20) (the discharge line (42)).

During the operation of the second compressor (20), the lubricant stored in the bottom portion of the casing (21) is drawn up to the oil supply passage (23*a*) by the oil tube (23*b*), and is supplied to the sliding portions of the compression mechanism (24). Since the high-pressure refrigerant that has been compressed by the compression mechanism (24) is discharged, the inside of the casing (21) of the second compressor (20) has a high pressure equivalent to the pressure of the discharged refrigerant. Thus, a portion of the lubricant supplied to the sliding portions flows into the low-pressure chambers of the first and second compression chambers (247, 248) (with an intermediate pressure), is compressed together with the refrigerant, and is then discharged into the space below the motor (22) in the casing (21) together with the refrigerant.

Relatively large-diameter ones of drops of the lubricant discharged into the space below the motor (22) in the casing (21) together with the refrigerant are subjected to the gravity force larger than the force received from the refrigerant which has been discharged from the compression mechanism (24) and which flows toward the discharge pipe (26), and thus fall to return to the bottom portion of the casing (21). Meanwhile, relatively small-diameter ones of the drops receive a larger force from the refrigerant than the gravity force, then pass (rise) through the gas passage (P2) together with the refrigerant, and are discharged through the discharge pipe (26) to the outside of the second compressor (20) (the discharge line (42)) together with the refrigerant.

Rates of Oil Loss in Compressors

As described above, the gas passage (P2) of the second compressor (20) is formed to have a larger passage cross-sectional area than the gas passage (P1) of the first compressor (10) does. For this reason, if the first, second compressors (10), (20) are operated under the same conditions (the same differential pressure, the same number of revolutions), the speed of the discharged refrigerant passing through the gas passage (P2) of the second compressor (20) is lower than that through the gas passage (P1) of each first compressor (10). This makes it easier for relatively small-diameter drops of the lubricant to be also separated from the discharged refrigerant in the second compressor (20). Thus, in this first embodiment, if the first, second compressors (10), (20) are operated under the same conditions, the amount of the lubricant (drops) returning to the bottom portion of the casing (21) of the second compressor (20) is larger, and the rate of oil loss (the weight of the lubricant discharged to the outside/the weight of fluid (the refrigerant and the lubricant) discharged to the outside) in the second compressor (20) is lower. That is to say, in this first embodiment, the gas passage (P2) of the second compressor (20) is formed to have a passage cross-sectional area that is larger than that of the gas passage (P1) of the first compressor (10). This allows the rate of oil loss in the second compressor (20) to be lower than that in the first compressor (10) measured under the same test conditions.

In the first embodiment, the oil separation mechanism (51) is provided only in the second compressor (20). Thus, while the lubricant that has not been separated from the refrigerant in the gas passage (P2) of the second compressor (20) comes into contact with the oil separation plate (52) of the oil separation mechanism (51), and passes through the filter (53), the lubricant is deposited on the oil separation plate (52) and the filter (53) so as to be captured, and falls to return to the bottom portion of the casing (21). Thus, in this first embodiment, providing the oil separation mechanism (51) only in the second compressor (20) as described above also allows the rate of oil loss in the second compressor (20) to be lower than that in the first compressor (10) measured under the same test conditions.

Advantages of First Embodiment

The compressor device (2) of this first embodiment includes the first compressors (10) and the second compressor (20). The first compressors (10) each include the casing (first casing) (11), the compression mechanism (first compression mechanism) (14), and the motor (first motor) (12). The casing (11) has a bottom portion in which the lubricant is to be stored. The compression mechanism (14) is provided in the casing (11) to compress the refrigerant and discharge the compressed refrigerant into the casing (11). The motor (12) is provided in the casing (11), includes the stator (121) and the rotor (122), and is configured to drive the compression mechanism (14). The second compressor (20) includes the casing (second casing) (21), the compression mechanism (second compression mechanism) (24), and the motor (second motor) (22). The casing (21) has a bottom portion in which the lubricant is to be stored. The compression mechanism (24) is provided in the casing (21) to compress the refrigerant and discharge the compressed refrigerant into the casing (21). The motor (22) is provided in the casing (21), includes the stator (221) and the rotor (222), and is configured to drive the compression mechanism (24). The second compressor (20) is configured to compress the refrigerant discharged from the first compressor (10). The motor (12) of each first compressor (10) has the gas passage (first passage)

(P1) which extends from one axial end to the other axial end thereof and through which the refrigerant discharged from the compression mechanism (14) passes. The motor (22) of the second compressor (20) has the gas passage (second passage) (P2) which extends from one axial end to the other axial end thereof and through which the refrigerant discharged from the compression mechanism (24) passes. In the compressor device (2) of this first embodiment, the cross-sectional area of the gas passage (P2) of the second compressor (20) is larger than that of the gas passage (P1) of the first compressor (10).

In the compressor device (2) of this first embodiment, the refrigerant compressed by the compression mechanism (14) of each first compressor (10) is discharged into the casing (11), flows through the gas passage (P1), and is then discharged to the outside of the first compressor (10). The refrigerant discharged from the first compressor (10) is sucked into the compression mechanism (24) of the second compressor (20) so as to be compressed. The refrigerant compressed by the compression mechanism (24) is discharged into the casing (21), flows through the gas passage (P2), and is then discharged to the outside of the second compressor (20). In this manner, the refrigerant is compressed in two stages by the first compressor (10) and the second compressor (20).

The refrigerant discharged from the compression mechanism (14, 24) of each compressor (10, 20) into the associated casing (11, 21) contains the lubricant. Relatively large-diameter ones of drops of the lubricant contained in the refrigerant discharged from the compression mechanism (14, 24) are subjected to the gravity force larger than the force received from the refrigerant which has been discharged from the compression mechanism (14, 24) and which flows toward the discharge pipe (16, 26), and are separated from the discharged refrigerant to return to the bottom portion of the casing (11, 21). Meanwhile, relatively small-diameter ones of the drops receive a larger force from the refrigerant than the gravity force, then pass through the gas passage (P1, P2) together with the refrigerant, and are discharged through the discharge pipe (16, 26) to the outside of the compressor (10, 20) together with the refrigerant. The amount of the lubricant sucked, together with the refrigerant, into the high-stage second compressor (20) that has a larger pressure difference between suction pressure and discharge pressure than the low-stage first compressor (10) does is larger than that of the low-stage first compressor (10). Thus, the amount of the lubricant discharged outside the high-stage second compressor (20) also tends to be larger. This is highly likely to cause a shortage of the lubricant in the second compressor (20).

To address such a problem, in the compressor device (2) of this first embodiment, the cross-sectional area of the gas passage (P2) of the second compressor (20) is set to be larger than that of the gas passage (P1) of the first compressor (10). For this reason, if the first, second compressors (10), (20) are operated under the same conditions (the same differential pressure, the same number of revolutions), the speed of the discharged refrigerant passing through the gas passage (P2) of the second compressor (20) is lower than that through the gas passage (P1) of each first compressor (10). This makes it easier for relatively small-diameter drops of the lubricant to be also separated from the discharged refrigerant in the second compressor (20). Thus, in the compressor device (2) of this first embodiment, if the first, second compressors (10), (20) are operated under the same conditions, the amount of the lubricant (drops) returning to the bottom portion of the casing (21) of the second compressor (20) is larger than that of the first compressor (10), and the rate of oil loss (the weight of the lubricant discharged to the outside/the weight of fluid (the refrigerant and the lubricant) discharged to the outside) in the second compressor (20) is lower than that in the first compressor (10). Thus, according to the compressor device (2) of this first embodiment, the amount of the lubricant to be discharged from the high-stage second compressor (20) can be reduced. This can avoid the situation where the high-stage second compressor (20) is short of the lubricant.

In the compressor device (2) of this first embodiment, only the gas passage (P2) of the second compressor (20) includes the rotor passage (P24) extending from one axial end to the other axial end of the rotor (222), and the gas passage (P1) of the first compressor (10) includes no rotor passage.

According to the compressor device (2) of this first embodiment, simply forming the rotor passage (P24) in the rotor (222) of the second compressor (20) allows the gas passage (P2) to be easily configured to have a cross-sectional area that is larger than that of the gas passage (P1).

In the compressor device (2) of the first embodiment, the gas passage (P1) of the first compressor (10) includes the stator passage (first stator passage) (P11) extending from one axial end to the other axial end of the stator (121) between the stator (121) of the motor (12) and the casing (11), and the gas passage (P2) of the second compressor (20) includes the stator passage (second stator passage) (P21) extending from one axial end to the other axial end of the stator (221) between the stator (221) of the motor (22) and the casing (21). In the compressor device (2) of this first embodiment, the cross-sectional area of the stator passage (P21) of the second compressor (20) is larger than that of the stator passage (P11) of the first compressor (10).

According to the compressor device (2) of this first embodiment, the stator passage (P11) is formed between the stator (121) and casing (11) of the first compressor (10), and the stator passage (P21) having a cross-sectional area that is larger than that of the stator passage (P11) of the first compressor (10) is formed between the stator (221) and casing (21) of the second compressor (20). This allows the gas passage (P2) to be easily configured to have a cross-sectional area that is larger than that of the gas passage (P1).

In the compressor device (2) of this first embodiment, the casing (21) of the second compressor (20) is connected to the discharge pipe (26) to guide the refrigerant discharged from the second compression mechanism (24) to the outside of the second casing (21). An oil separation member (the oil separation plate (52) and the filter (53)) is provided only for the second compressor (20), and the oil separation member is provided between the gas passage (P2) and the discharge pipe (26) in the casing (21).

According to the compressor device (2) of the first embodiment, providing the oil separation member (the oil separation plate (52) and the filter (53)) that separates the lubricant contained in the discharged refrigerant only for the second compressor (20) can further reduce the amount of the lubricant to be discharged from the high-stage second compressor (20).

In the compressor device (2) of this first embodiment, the filter (53) is used as the oil separation member. Such a configuration allows the oil separation member to be easily configured to separate the lubricant contained in the refrigerant discharged from the compression mechanism (24) of the second compressor (20).

In the compressor device (2) of this first embodiment, the oil separation plate (52) is used as the oil separation member.

Such a configuration allows the oil separation member to be easily configured to separate the lubricant contained in the refrigerant discharged from the compression mechanism (24) of the second compressor (20).

The refrigeration apparatus (1) of this first embodiment includes the above-described compressor device (2). Thus, this first embodiment can provide a highly reliable refrigeration apparatus (1) that substantially prevents the situation where the second compressor (20) is short of the lubricant from occurring.

First Variation of First Embodiment

Figure 7:
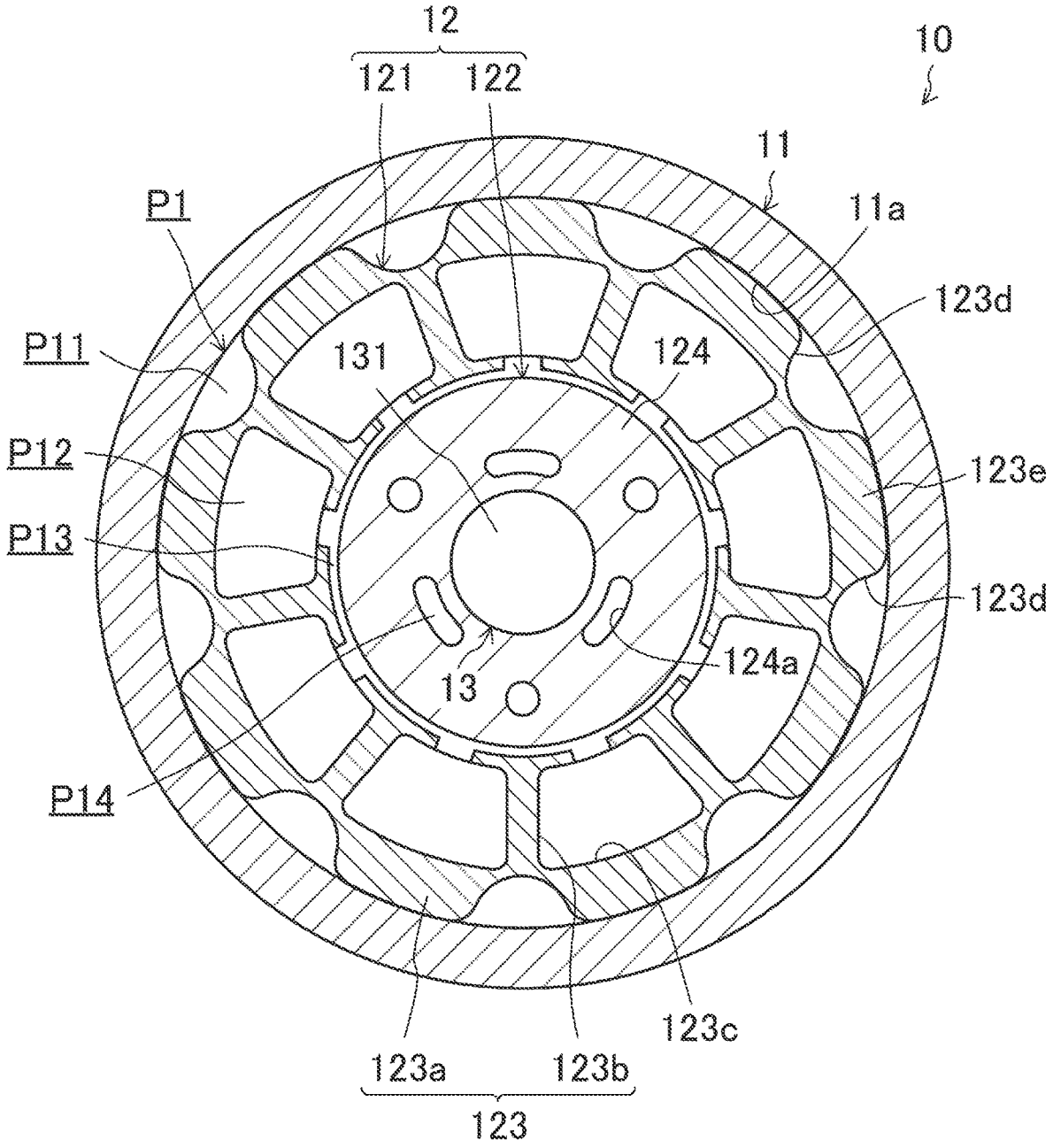
FIG. 7 is a transverse sectional view of a motor portion of a first compressor of a compressor device according to a first variation of the first embodiment.

In a first variation of the first embodiment, as illustrated in FIG. 7, each first compressor (10) also has a rotor passage (first rotor passage) (P14). The passage cross-sectional area of the rotor passage (second rotor passage) (P24) of the second compressor (20) is configured to be larger than that of the rotor passage (P14) of the first compressor (10).

Specifically, as illustrated in FIG. 7, the motor (12) of the first compressor (10) also includes a rotor core (124) having an inner peripheral portion with a plurality of holes (124*a*, 124*a*, 124*a*). Each of the holes (124*a*) is a through hole extending from the upper end surface to the lower end surface of the rotor core (124). In this first variation, the holes (124*a*) have the same shape as each hole (224*a*) of the rotor core (224) of the second compressor (20), and the number of the holes (124*a*) (in this variation, three) is less than that of the holes (224*a*) of the second compressor (20). The plurality of holes (124*a*, . . . , 124*a*) are equally spaced on the circumference of the same circle on the inner peripheral portion of the rotor core (124).

According to this configuration, in the first variation, the gas passage (P1) of the first compressor (10) includes the rotor passage (first rotor passage) (P14) in addition to a stator passage (first stator passage) (P11), a tooth-to-tooth passage (P12), and a core-to-core passage (P13) which are similar to those of the first embodiment.

The rotor passage (P14) is configured as a plurality of (in this first variation, three) passages formed inside the rotor core (124) by the plurality of (in this first embodiment, three) holes (124*a*, 124*a*, 124*a*) formed in the inner peripheral portion of the rotor core (124).

Size Relationship in Cross-Sectional Area Between Gas Passages

Also in the first variation of the first embodiment, the cross-sectional area (the area of the cross section perpendicular to the axial direction of the drive shaft (23)) of the gas passage (P2) of the second compressor (20) is larger than the cross-sectional area (the area of the cross section perpendicular to the axial direction of the drive shaft (13)) of the gas passage (P1) of the first compressor (10).

Specifically, also in the first variation of the first embodiment, the passage cross-sectional area of the tooth-to-tooth passage (P12) formed in the first compressor (10) is equal to that of the tooth-to-tooth passage (P22) formed in the second compressor (20), and the passage cross-sectional area of the core-to-core passage (P13) formed in the first compressor (10) is equal to that of the core-to-core passage (P23) formed in the second compressor (20). Meanwhile, the stator passage (P21) of the second compressor (20) has a larger passage cross-sectional area than the stator passage (P11) of the first compressor (10) does.

Furthermore, in the first variation of the first embodiment, the passage cross-sectional area of the rotor passage (P24) formed in the second compressor (20) is larger than that of the rotor passage (P14) formed in the first compressor (10).

As described above, in this first variation, the number of the holes (224*a*) of the rotor core (224) of the second compressor (20) is set to be greater than that of the holes (124*a*) of the rotor core (124) of the first compressor (10). This allows the passage cross-sectional area of the rotor passage (P24) of the second compressor (20) to be larger than that of the rotor passage (P14) of the first compressor (10).

As can be seen from the foregoing description, in the first variation of the first embodiment, the stator passages (P11, P21) are configured such that the cross-sectional area of the stator passage (P21) of the second compressor (20) is larger than that of the stator passage (P11) of the first compressor (10), and the rotor passages (P14, P24) are configured such that the cross-sectional area of the rotor passage (P24) of the second compressor (20) is larger than that of the rotor passage (P14) of the first compressor (10). This allows the cross-sectional area of the gas passage (P2) of the second compressor (20) to be larger than that of the gas passage (P1) of the first compressor (10).

In the first variation, other configurations are the same as, or similar to, those of the first embodiment.

As can be seen, in the compressor device (2) of the first variation of the first embodiment, the gas passage (P1) of the first compressor (10) includes the rotor passage (first rotor passage) (P14) extending from one axial end to the other axial end of the rotor (122) of the motor (12), and the gas passage (P2) of the second compressor (20) includes the rotor passage (second rotor passage) (P24) extending from one axial end to the other axial end of the rotor (222) of the motor (22). In the compressor device (2) of this first variation, the cross-sectional area of the rotor passage (P24) of the second compressor (20) is larger than that of the rotor passage (P14) of the first compressor (10).

The compressor device (2) of the first variation of the first embodiment can also provide advantages that are the same as, or similar to, those of the first embodiment.

According to the compressor device (2) of the first variation of the first embodiment, the rotor (122) of the first compressor (10) has the rotor passage (P14), and the rotor (222) of the second compressor (20) has the rotor passage (P24) the cross-sectional area of which is larger than that of the rotor passage (P14) of the first compressor (10). This allows the gas passage (P2) to be easily configured to have a cross-sectional area that is larger than that of the gas passage (P1).

Second Embodiment

A second embodiment is a modified version of the first embodiment, in which the configuration of the compressor device (2) has been partially modified. Specifically, in the second embodiment, first compressors (10) are configured as scroll compressors, and a second compressor (20) is configured as a rotary compressor. The other configurations of a refrigeration apparatus (1) is the same as, or similar to, those of the first embodiment. Thus, only the configurations of the first, second compressors (10), (20) different from those of the first embodiment will now be described.

First Compressor

Figure 8:
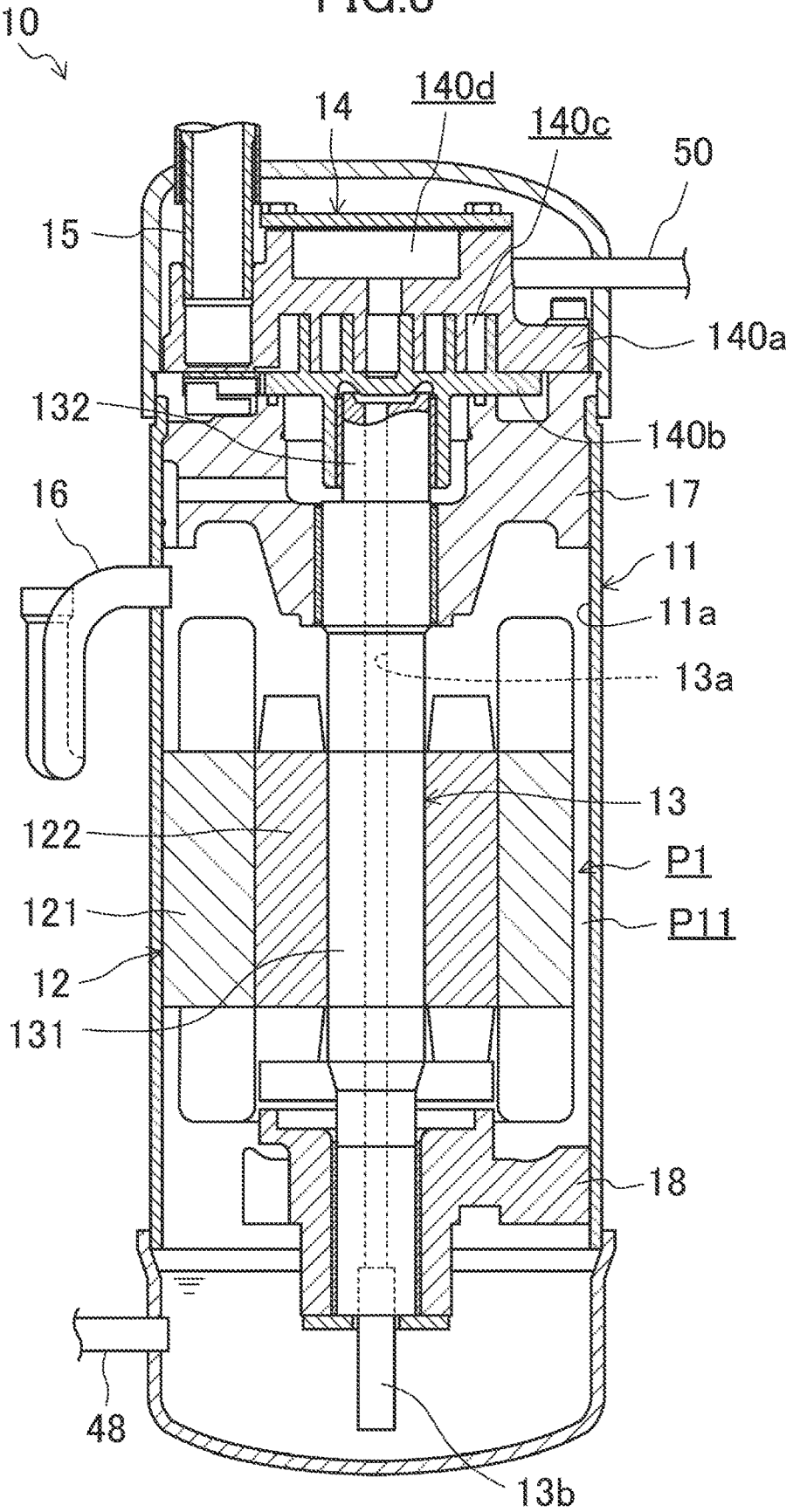
FIG. 8 is a longitudinal sectional view of a first compressor of a compressor device according to a second embodiment.

As illustrated in FIG. 8, each of the first compressors (10) includes one casing (first casing) (11), one motor (first motor) (12), one drive shaft (13), one compression mechanism (first compression mechanism) (14), one suction pipe (15), one discharge pipe (first discharge pipe) (16), an upper bearing (17), and a lower bearing (18). The compression mechanism (14), the motor (12), the drive shaft (13), the upper bearing (17), and the lower bearing (18) are provided in the casing (11), and the suction pipe (15) and the discharge pipe (16) are provided to run through the casing (11) from the inside toward the outside of the casing (11).

The casing (11) is formed in the shape of a vertically oriented substantial cylinder. The casing (11) is configured to be able to withstand the intermediate pressure during operation of the refrigeration apparatus (1). The bottom portion of the casing (11) stores lubricant.

The motor (12) has a configuration that is the same as, or similar to, that of the first compressor (10) of the first embodiment.

The drive shaft (13) has a main shaft portion (131) and one eccentric portion (132). The main shaft portion (131) is provided in the cylindrical casing (11) such that their center axes coincide with each other. A rotor (122) of the motor (12) is fixed to an intermediate portion of the main shaft portion (131) in the top-to-bottom direction. The eccentric portion (132) is formed above the main shaft portion (131). The drive shaft (13) has therein an oil supply passage (13*a*) through which the lubricant is to be supplied to sliding portions of the compression mechanism (14). The lower end of the drive shaft (13) is provided with an oil tube (13*b*) for drawing the lubricant stored in the bottom portion of the casing (11) to the oil supply passage (13*a*).

The compression mechanism (14) includes a fixed scroll (140*a*), and an orbiting scroll (140*b*) meshing with the fixed scroll (140*a*). The fixed scroll (140*a*) and the orbiting scroll (140*b*) meshing with each other allow a compression chamber (140*c*) to be formed between the fixed scroll (140*a*) and the orbiting scroll (140*b*). The eccentric portion (132) of the drive shaft (13) is fitted into a lower end portion of the orbiting scroll (140*b*). The rotation of the drive shaft (13) causes the orbiting scroll (140*b*) to revolve around the center axis of the drive shaft (13). Thus, the volume of the compression chamber (140*c*) varies, and a refrigerant is compressed.

An upper portion of the fixed scroll (140*a*) defines a muffler space (140*d*) into which the refrigerant compressed in the compression chamber (140*c*) is discharged. The muffler space (140*d*) is connected to a space below the motor (12) in the casing (11) through a discharge passage (not shown). Thus, the refrigerant compressed in the compression chamber (140*c*) of the compression mechanism (14) is discharged into the space below the motor (12) in the casing (11).

The suction pipe (15) is provided at the upper portion of the casing (11) to run through an upper wall portion of the casing (11) from the inside toward the outside of the casing (21). The suction pipe (15) is provided to run through the fixed scroll (140*a*), and guides the low-pressure refrigerant to the compression chamber (140*c*).

The discharge pipe (16) is provided above the motor (12) in the casing (11) to run through a sidewall portion of the casing (11) from the inside toward the outside of the casing (11). The discharge pipe (16) guides the refrigerant which has been discharged from the compression mechanism (14) into the space below the motor (12) and which has passed through the gas passage (P1) of the motor (12) to reach a space above the motor (12), to the outside of the casing (11) (the intermediate pressure line (47) connected to the discharge pipe (16)).

The upper bearing (17) is fixed to an upper portion of the sidewall portion of the casing (11) to rotatably support an upper end portion of the main shaft portion (131) of the drive shaft (13).

The lower bearing (18) is fixed to a lower portion of the sidewall portion of the casing (11) to rotatably support a lower end portion of the main shaft portion (131) of the drive shaft (13).

Second Compressor

Figure 9:
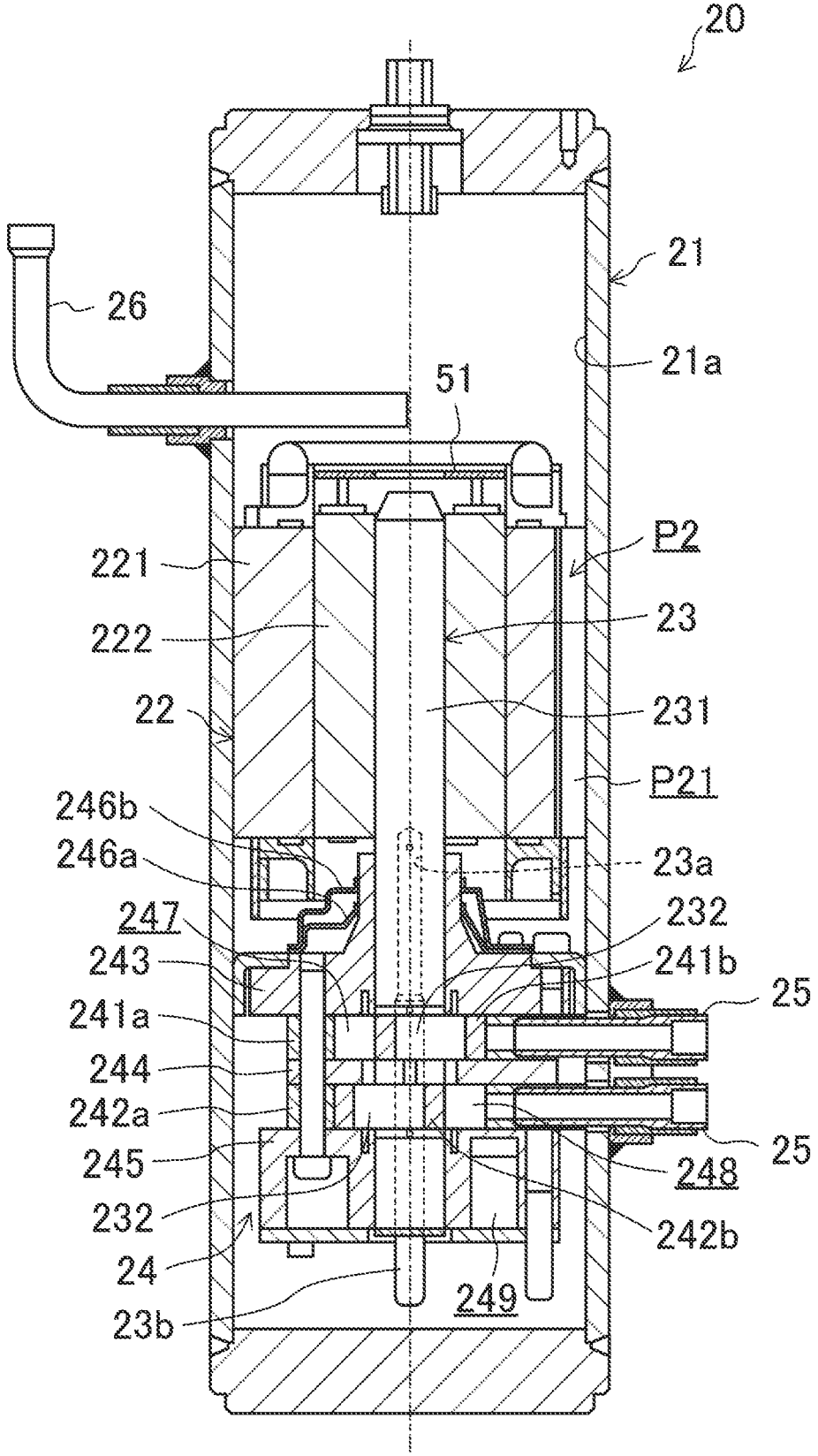
FIG. 9 is a longitudinal sectional view of a second compressor of the compressor device according to the second embodiment.

As illustrated in FIG. 9, the second compressor (20) has a configuration that is the same as, or similar to, that of the second compressor (20) of the first embodiment. Only the configuration of a gas passage (P2) is distinct from that of the second compressor (20) of the first embodiment.

In the second embodiment, the gas passage (P2) of the second compressor (20) is the same as, or similar to, the gas passage (P1) of the first compressor (10) of the first embodiment. In other words, a rotor core (224) of the second compressor (20) of the second embodiment has no holes (224*a*), and the gas passage (P2) includes no rotor passage (P24). In the second embodiment, nine protrusions (223*e*, . . . , 223*e*) each formed between an associated adjacent pair of nine core cuts (223*d*, . . . , 223*d*) of a stator core (223) of the second compressor (20) each have a distal end portion that is not cut way, and are fixed to the inner surface of the sidewall portion of the casing (21). Thus, in the second embodiment, the passage cross-sectional area of the stator passage (P11) formed in each first compressor (10) is equal to that of the stator passage (P21) formed in the second compressor (20).

As can be seen from the foregoing description, in the second embodiment, the gas passages (P1, P2) formed in the first, second compressors (10), (20) have the same passage cross-sectional area.

Advantages of Second Embodiment

In the compression device (2) of the second embodiment, scroll compressors are used as the first compressors (10), and a rotary compressor is used as the second compressor (20).

The rotary compressor including less sliding portions than the scroll compressor merely requires a small amount of lubricant to be supplied to the compression mechanism. This reduces the lubricant sucked into the compression chamber. As a result, the amount of the lubricant discharged to the outside of the compressor also decreases. Thus, in general, the rate of oil loss in a rotary compressor is lower than that in a scroll compressor. Thus, according to the compressor device (2) of the second embodiment, scroll compressors are used as the first compressors (10), and a rotary compressor in which the rate of oil loss is lower than that in the scroll compressor is used as the second compressor (20). Such a simple configuration can reduce the amount of lubricant to be discharged from the high-stage second compressor (20). Thus, just like the first embodiment, the second embodiment can also avoid the situation where the high-stage second compressor (20) is short of the lubricant, and can also provide a highly reliable refrigeration apparatus (1) that substantially prevents such a situation from occurring.

First Variation of Second Embodiment

Although not shown, a second compressor (20) according to a first variation of the second embodiment has a configuration that is the same as, or similar to, the second compressor (20) of the first embodiment.

With such a configuration, not only the second compressor (20) configured as a rotary compressor in which the rate of oil loss is lower than that in each of first compressors (10) configured as scroll compressors, but also the size relationship between the cross-sectional areas of the gas passages (P1, P2) of the motors (12, 22) allow the rate of oil loss in the second compressor (20) to be lower than that in the first compressor (10). This can further reduce the amount of the lubricant to be discharged from the high-stage second compressor (20).

Second Variation of Second Embodiment

In a second variation of the second embodiment, although not shown, a motor (12) of each of first compressors (10) also has a rotor passage (P14) just like the first variation of the first embodiment. The passage cross-sectional area of a rotor passage (P24) of a second compressor (20) is configured to be larger than that of the rotor passage (P14) of each first compressor (10).

With such a configuration, not only the second compressor (20) configured as a rotary compressor in which the rate of oil loss is lower than that in each of first compressors (10) configured as scroll compressors, but also the size relationship between the cross-sectional areas of the gas passages (P1, P2) of the motors (12, 22) allow the rate of oil loss in the second compressor (20) to be lower than that in the first compressor (10). This can further reduce the amount of the lubricant to be discharged from the high-stage second compressor (20).

Third Embodiment

A third embodiment is a modified version of the first embodiment, in which the configuration of the compressor device (2) has been partially modified. Specifically, a second compressor (20) according to the third embodiment has a configuration that is the same as, or similar to, the second compressor (20) of the second embodiment illustrated in FIG. 9. In other words, in the third embodiment, first compressors (10) and the second compressor (20) have nearly the same configuration. The only difference in configuration between the first and second compressors (10) and (20) is that only the second compressor (20) is provided with an oil separation mechanism (51).

According to such a configuration, only the second compressor (20) is provided with the oil separation mechanism (51) separating lubricant contained in a discharged refrigerant. Thus, if the first, second compressors (10), (20) are operated under the same conditions, the amount of the lubricant (drops) returning to the bottom portion of the casing (21) of the second compressor (20) is larger, and the rate of oil loss (the weight of the lubricant discharged to the outside/the weight of fluid (the refrigerant and the lubricant) discharged to the outside) in the second compressor (20) is lower. Thus, according to the compressor device (2) of the third embodiment, the amount of the lubricant to be discharged from the high-stage second compressor (20) can be reduced. Thus, just like the first embodiment, the third embodiment can also avoid the situation where the high-stage second compressor (20) is short of the lubricant, and can also provide a highly reliable refrigeration apparatus (1) that substantially prevents such a situation from occurring.

Fourth Embodiment

Figure 10:
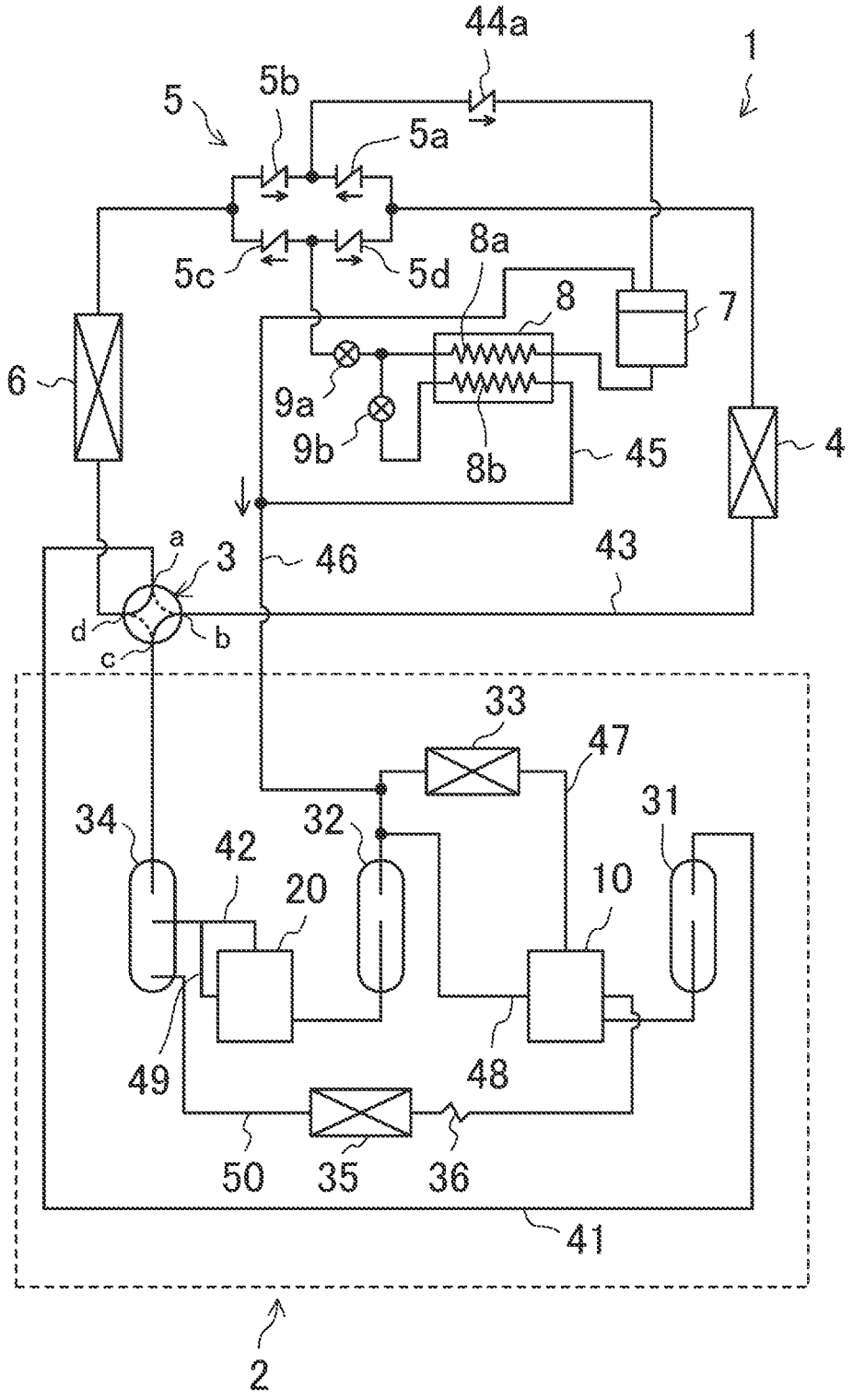
FIG. 10 illustrates a refrigerant circuit of a refrigeration apparatus according to a fourth embodiment.

A fourth embodiment is a modified version of the first embodiment, in which the configuration of the compressor device (2) has been partially modified, as illustrated in FIG. 10. Specifically, a compressor device (2) of the fourth embodiment is a modified version of the compressor device (2) of the first embodiment, in which the compressor device (2) includes only one first compressor (10) instead of the two first compressors (10) included in the compressor device (2) of the first embodiment, and likewise includes only one first accumulator (31) instead of the two first accumulators (31) included in the compressor device (2) of the first embodiment. In other words, the compressor device (2) of the fourth embodiment includes the one first compressor (10) and one second compressor (20), which compress a refrigerant in two stages.

Such a configuration can also provide advantages that are the same as, or similar to, those of the first embodiment.

Other Embodiments

In each of the foregoing embodiments and variations, the rate of oil loss in the second compressor (20) is configured to be lower than that in each first compressor (10) measured under the same test conditions, through a technique in which the gas passages (P1, P2) have different cross-sectional areas, a technique in which different types of constituent compressors (a scroll compressor, a rotary compressor) are used, or a technique in which only either the first compressor (10) or the second compressor (20) is provided with the oil separation mechanism (51). However, the compressor device (2) may be configured such that, through a technique except the above-described techniques, the rate of oil loss in the second compressor (20) is made lower than that in the first compressor (10) measured under the same test conditions.

In each of the foregoing embodiments and variations, a situation has been described where the passage cross-sectional area of each of the gas passages (P1, P2) is uniform from the upper end to the lower end (from one axial end to the other axial end) thereof. However, the gas passages (P1, P2) do not have to have a uniform passage cross-sectional area. If the passage cross-sectional area of each of the gas passages (P1, P2) is not uniform, the passage cross-sectional area of a portion of the gas passage (P2) of the second compressor (20) with the smallest passage cross-sectional area merely needs to be configured to be larger than that of a portion of the gas passage (P1) of the first compressor (10) with the smallest passage cross-sectional area. Such a configuration allows the rate of oil loss in the second compressor (20) to be lower than that in the first compressor (10) measured under the same test conditions.

In each of the foregoing embodiments and variations, an example has been described in which the compressor device (2) includes the first, second compressors (10), (20), which compress the refrigerant in two stages. However, the compressor device (2) may include three or more compressors connected together in series, and may compress the refrigerant in three or more stages. In this case, in one preferred embodiment, the rate of oil loss in a high-stage one of two of the compressors connected together in series is configured to be lower than that in a low-stage compressor, and the rate of oil loss in the highest-stage compressor is configured to be the lowest.

In each of the foregoing embodiments and variations, an example in which the second compressor (20) is provided with the oil separation mechanism (51) including the oil separation plate (52) and the filter (53) has been described. However, the second compressor (20) may be provided with any oil separation member that can capture the lubricant contained in the refrigerant until the refrigerant that has passed through the gas passage (P2) of the second compressor (20) reaches the discharge pipe (26), instead of the oil separation mechanism (51). For example, only the oil separation plate (52) or the filter (53) may be provided, and the installation position of such a component is not limited to the position described above.

In the first embodiment, the gas passages (P1, P2) are configured such that the cross-sectional area of the stator passage (P21) of the second compressor (20) is larger than that of the stator passage (P11) of each first compressor (10) and such that only the gas passage (P2) of the second compressor (20) includes the rotor passage (P24). This allows the cross-sectional area of the gas passage (P2) of the second compressor (20) to be larger than that of the gas passage of the first compressor (10). In the first variation of the first embodiment, the cross-sectional area of the stator passage (P21) formed in the second compressor (20) is larger than that of the stator passage (P11) formed in the first compressor (10), and the rotor passages (P13, P24) are configured such that the cross-sectional area of the rotor passage (P24) of the second compressor (20) is larger than that of the rotor passage (P14) of the first compressor (10). This allows the cross-sectional area of the gas passage (P2) of the second compressor (20) to be larger than that of the gas passage of the first compressor (10). However, the technique in which the cross-sectional area of the gas passage (P2) of the second compressor (20) is made larger than that of the gas passage (P1) of the first compressor (10) is not limited to the techniques of the first embodiment and the first variation of the first embodiment.

For example, all of the stator passage (P21), the tooth-to-tooth passage (P22), the core-to-core passage (P23), and the rotor passage (P24) of the second compressor (20) may have a larger passage cross-sectional area than an associated one of the stator passage (P11), the tooth-to-tooth passage (P12), the core-to-core passage (P13), and the rotor passage (P14) of the first compressor (10) in order to allow the cross-sectional area of the gas passage (P2) of the second compressor (20) to be larger than that of the gas passage of each first compressor (10). Alternatively, any one of the stator passage (P21), the tooth-to-tooth passage (P22), the core-to-core passage (P23), and the rotor passage (P24) of the second compressor (20) may have a larger passage cross-sectional area than an associated one of the stator passage (P11), the tooth-to-tooth passage (P12), the core-to-core passage (P13), and the rotor passage (P14) of the first compressor (10) in order to allow the cross-sectional area of the gas passage (P2) of the second compressor (20) to be larger than that of the gas passage (P1) of the first compressor (10).

In each of the foregoing embodiments and variations, an example in which a swing rotary compressor is used as the rotary compressor has been described. However, a rotary compressor of a type except a swing type may be used.

While the embodiments and variations thereof have been described above, it will be understood that various changes in form and details may be made without departing from the spirit and scope of the claims. The embodiments and the variations thereof may be combined and replaced with each other without deteriorating intended functions of the present disclosure.

As can be seen from the foregoing description, the present disclosure is useful for a compressor device and a refrigeration apparatus.

The invention claimed is:

1. A compressor device, comprising:

a first compressor including:

a first casing having a bottom portion in which lubricant is to be stored, a first compression mechanism provided in the first casing to compress a refrigerant and discharge the compressed refrigerant into the first casing, and a first motor provided in the first casing, the first motor including a first stator and a first rotor, and the first motor being configured to drive the first compression mechanism; and a second compressor including:

a second casing having a bottom portion in which lubricant is to be stored, a second compression mechanism provided in the second casing to compress a refrigerant and discharge the compressed refrigerant into the second casing, and a second motor provided in the second casing, the second motor including a second stator and a second rotor, and the second motor being configured to drive the second compression mechanism, the second compressor being configured to compress the refrigerant discharged from the first compressor of the same compressor device, the first motor having a first passage extending in an axial direction of the first motor and through which the refrigerant discharged from the first compression mechanism passes, the second motor having a second passage extending in an axial direction of the second motor and through which the refrigerant discharged from the second compression mechanism passes, a cross-sectional area of the second passage being larger than a cross-sectional area of the first passage, and of the first and second passages, only the second passage of the second motor including a second rotor passage configured by a plurality of holes extending from one axial end to another axial end through the second rotor of the second motor, the first passage not including a first rotor passage configured by a plurality of holes extending from one axial end to another axial end through the first rotor of the first motor.

2. The compressor device of claim 1, wherein, the first passage includes a first stator passage extending from one axial end to another axial end of the stator of the first motor between the stator of the first motor and the first casing, the second passage includes a second stator passage extending from one axial end to another axial end of the stator of the second motor between the stator of the second motor and the second casing, and a cross-sectional area of the second stator passage is larger than a cross-sectional area of the first stator passage.

3. The compressor device of claim 1, wherein the second casing is connected to a second discharge pipe to guide the refrigerant discharged from the second compression mechanism to outside of the second casing, of the first and second compressors, only the second compressor includes an oil separation member, and the oil separation member is provided between the second passage and the second discharge pipe in the second casing.

4. The compressor device of claim 3, wherein the oil separation member is a filter.

5. The compressor device of claim 3, wherein the oil separation member is an oil separation plate.

6. The compressor device of claim 1, wherein the first compressor is a scroll compressor, and the second compressor is a rotary compressor.

7. A refrigeration apparatus including the compressor device of claim 1.

8. A compressor device comprising:

a first compressor including:

a first casing having a bottom portion in which lubricant is to be stored, a first compression mechanism provided in the first casing to compress a refrigerant and discharge the compressed refrigerant into the first casing, and a first motor provided in the first casing, the first motor including a first stator and a first rotor, and the first motor being configured to drive the first compression mechanism; and a second compressor including:

a second casing having a bottom portion in which lubricant is to be stored, a second compression mechanism provided in the second casing to compress a refrigerant and discharge the compressed refrigerant into the second casing, and a second motor provided in the second casing, the second motor including a second stator and a second rotor, and the second motor being configured to drive the second compression mechanism, the second compressor being configured to compress the refrigerant discharged from the first compressor of the same compressor device, the first motor having a first passage extending in an axial direction of the first motor and through which the refrigerant discharged from the first compression mechanism passes, the second motor having a second passage extending in an axial direction of the second motor and through which the refrigerant discharged from the second compression mechanism passes, a cross-sectional area of the second passage being larger than a cross-sectional area of the first passage, the first passage of the first motor including a first rotor passage configured by a plurality of first holes extending from one axial end to another axial end through the first rotor of the first motor, the second passage of the second motor including a second rotor passage configured by a plurality of second holes extending from one axial end to another axial end through the second rotor of the second motor, and a cross-sectional area of the second rotor passage of the second motor being larger than a cross-sectional area of the first rotor passage of the first motor.

9. The compressor device of claim 8, wherein the first passage includes a first stator passage extending from one axial end to another axial end of the stator of the first motor between the stator of the first motor and the first casing, the second passage includes a second stator passage extending from one axial end to another axial end of the stator of the second motor between the stator of the second motor and the second casing, and a cross-sectional area of the second stator passage is larger than a cross-sectional area of the first stator passage.

10. The compressor device of claim 8, wherein the first compressor is a scroll compressor, and the second compressor is a rotary compressor.

11. A refrigeration apparatus including the compressor device of claim 8.

12. The compressor device of claim 8, wherein the second casing is connected to a second discharge pipe to guide the refrigerant discharged from the second compression mechanism to outside of the second casing, of the first and second compressors, only the second compressor includes an oil separation member, and the oil separation member is provided between the second passage and the second discharge pipe in the second casing.

13. The compressor device of claim 12, wherein the oil separation member is a filter.

14. The compressor device of claim 12, wherein the oil separation member is an oil separation plate.

* * * * *